United States Patent [19]

Maskasky

[11] 4,400,463

[45] Aug. 23, 1983

[54] SILVER CHLORIDE EMULSIONS OF MODIFIED CRYSTAL HABIT AND PROCESSES FOR THEIR PREPARATION

[75] Inventor: Joe E. Maskasky, Rochester, N.Y.

[73] Assignee: Eastman Kodak Company, Rochester, N.Y.

[21] Appl. No.: 431,455

[22] Filed: Sep. 30, 1982

Related U.S. Application Data

[63] Continuation-in-part of Ser. No. 320,898, Nov. 12, 1981, abandoned.

[51] Int. Cl.[3] ..... G03C 5/26; G03C 1/76; G03C 1/02

[52] U.S. Cl. ..... 430/434; 430/495; 430/496; 430/564; 430/567; 430/569; 430/615; 430/629

[58] Field of Search ..... 430/569, 567, 495, 496, 430/564, 434, 600, 615, 629

[56] References Cited

U.S. PATENT DOCUMENTS 3,519,426 7/1970 Halwig ..... 430/567

OTHER PUBLICATIONS

Chem. Absts. vol. 68, 1968, 64577e.

Duffin, Photographic Emulsion Chemistry, 1966, pp. 66–72.

Trivelli and Smith, "The Effect of Silver Iodide Upon the Structure of Bromo-Iodide Precipitation Series," The Photo. Journal vol. LXXX, 1940, pp. 285–288.

Gutoff, "Nucleation and Growth Rates During the Precipitation of Silver Halide Photographic Emulsions", Photo Sci. & Eng., vol. 14, No. 4, pp. 248–257.

*Primary Examiner*—Mary F. Downey

*Attorney, Agent, or Firm*—Carl O. Thomas

[57] ABSTRACT

Radiation-sensitive photographic emulsions are disclosed comprised of a dispersing medium and silver halide grains the halide content of which is at least 50 mole percent chloride, based on silver. The silver halide grains include tabular grains having a thickness of less than 0.5 micron, a diameter of at least 0.6 micron, and an average aspect ratio greater than 8:1 which account for at least 50 percent of the total projected area of the silver halide grains. The tabular grains have two opposed substantially parallel major crystal faces lying in {111} crystal planes and exhibiting at least one of the following features: (1) at least one peripheral edge lying parallel to a <211> crystallographic vector lying in the plane of one of the major faces and (2) bromide and/or iodide incorporated in a central grain region. The tabular grains are formed in the presence of an aminoazaindene and a peptizer having a thioether linkage.

30 Claims, 30 Drawing Figures

FIG. 3
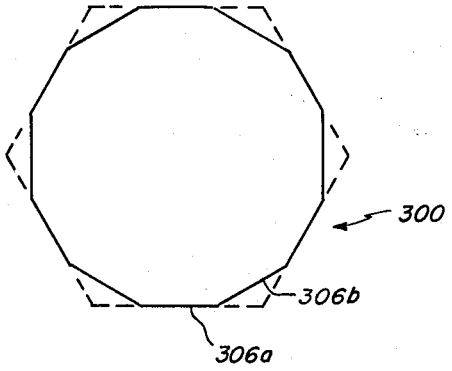
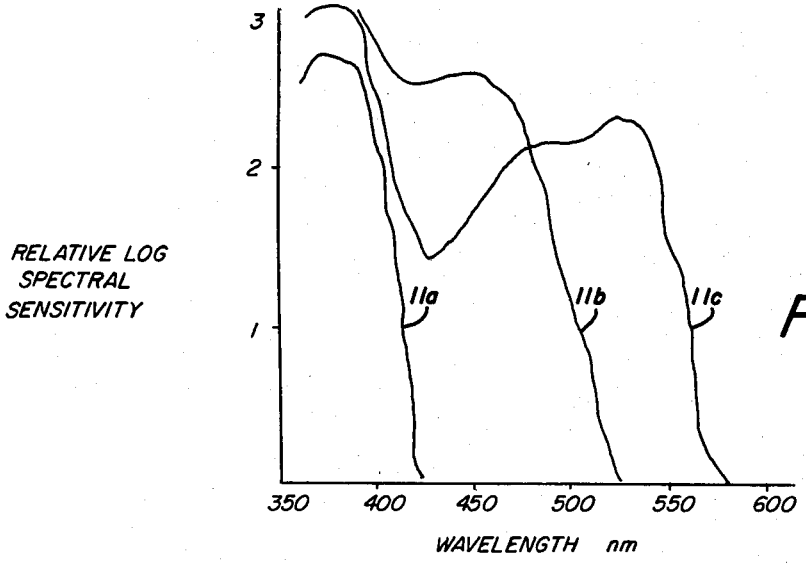
FIG. 11a

SILVER CHLORIDE EMULSIONS OF MODIFIED CRYSTAL HABIT AND PROCESSES FOR THEIR PREPARATION

This is a continuation-in-part of copending, commonly assigned U.S. Ser. No. 320,898, filed Nov. 12, 1981, now abandoned.

FIELD OF THE INVENTION

The present invention is drawn to radiation-sensitive photographic emulsions containing silver chloride and to processes for their preparation. More specifically, the invention is drawn to predominantly tabular grain emulsions in which the tabular grains are predominantly silver chloride and to processes of precipitation which produce these tabular grains.

BACKGROUND OF THE INVENTION

Radiation-sensitive silver chloride containing photographic emulsions are known to offer specific advantages. For example, silver chloride exhibits less native sensitivity to the visible portion of the spectrum than other photographically useful silver halides. Further, silver chloride is more soluble than other photographically useful silver halides, thereby permitting development and fixing to be achieved in shorter times.

It is well recognized in the art that silver chloride strongly favors the formation of crystals having {100} crystal faces. In the overwhelming majority of photographic emulsions silver chloride crystals when present are in the form of cubic grains. With some difficulty it has been possible to modify the crystal habit of silver chloride. Claes et al, "Crystal Habit Modification of AgCl by Impurities Determining Solvation", *The Journal of Photographic Science,* Vol. 21, pp. 39–50, 1973, teaches the formation of silver chloride crystals with {110} and {111} faces through the use of various grain growth modifiers. Wyrsch, "Sulfur Sensitization of Monosized Silver Chloride Emulsions with {111}, {110}, and {100} Crystal Habit", Paper III-13, *International Congress of Photographic Science,* pp. 122–124, 1978, discloses a triple-jet precipitation process in which silver chloride is precipitated in the presence of ammonia and small amounts of divalent cadmium ions. In the presence of cadmium ions control of pAg (the negative logrithim of silver ion concentration) and pH resulted in the formation of rhombododecahedral, octahedral, and cubic crystal habits, presenting grain faces lying in {110}, {111}, and {100} crystallographic planes, respectively.

Tabular silver bromide grains have been extensively studied, often in macro-sizes having no photographic utility. Tabular grains are herein defined as those having two substantially parallel crystal faces, each of which is substantially larger than any other single crystal face of the grain. The aspect ratio—that is, the ratio of diameter to thickness—of tabular grains is substantially greater than 1:1. High aspect ratio tabular grain silver bromide emulsions were reported by deCugnac and Chateau, "Evolution of the Morphology of Silver Bromide Crystals During Physical Ripening", *Science et Industries Photographiques,* Vol. 33, No. 2 (1962), pp. 121–125.

From 1937 until the 1950's the Eastman Kodak Company sold a Duplitized® radiographic film product under the name No-Screen X-Ray Code 5133. The product contained as coatings on opposite major faces of a film support sulfur sensitized silver bromide emulsions. Since the emulsions were intended to be exposed by X-radiation, they were not spectrally sensitized. The tabular grains had an average aspect ratio in the range of from about 5 to 7:1. The tabular grains accounted for greater than 50% of the projected area while nontabular grains accounted for greater than 25% of the projected area. The emulsion having the highest average aspect ratio, chosen from several remakes, had an average tabular grain diameter of 2.5 microns, an average tabular grain thickness of 0.36 micron, and an average aspect ratio of 7:1. In other remakes the emulsions contained thicker, smaller diameter tabular grains which were of lower average aspect ratio.

Although tabular grain silver bromoiodide emulsions are known in the art, none exhibit a high average aspect ratio. A discussion of tabular silver bromoiodide grains appears in Duffin, *Photographic Emulsion Chemistry,* Focal Press, 1966, pp. 66–72, and Trivelli and Smith, "The Effect of Silver Iodide Upon the Structure of Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Gutoff, "Nucleation and Growth Rates During the Precipitation of Silver Halide Photographic Emulsions", *Photographic Sciences and Engineering,* Vol. 14, No. 4, July-August 1970, pp. 248–257, reports preparing silver bromide and silver bromoiodide emulsions of the type prepared by single-jet precipitations using a continuous precipitation apparatus.

Bogg, Lewis, and Maternaghan have recently published specific processes of preparing silver halide emulsions in which the grains are tabular—that is areally extended as compared to their thickness. Bogg U.S. Pat. No. 4,063,951 teaches forming silver halide crystals of tabular habit bounded by {100} cubic faces and having an aspect ratio (here the ratio of edge length to thickness) of from 1.5 to 7:1 by a double-jet precipitation technique in which pAg is controlled within the range of from 5.0 to 7.0. As shown in FIG. 3 of Bogg, the silver halide grains formed exhibit square and rectangular major surfaces characteristic of {100} crystal faces. Lewis U.S. Pat. No. 4,067,739 teaches the preparation of monosize silver halide emulsions wherein most of the crystals are of the twinned octahedral type by forming seed crystals, causing the seed crystals to increase in size by Ostwald ripening in the presence of a silver halide solvent, and completing grain growth without renucleation or Ostwald ripening while controlling pBr (the negative logarithm of bromide ion concentration). Lewis does not mention silver chloride. Maternaghan U.S. Pat. Nos. 4,150,994, 4,184,877, and 4,184,878, U.K. Pat. No. 1,570,581, and German OLS publications Nos. 2,905,655 and 2,921,077 teach the formation of silver halide grains of flat twinned octahedral configuration by employing seed crystals which are at least 90 mole percent iodide. (Except as otherwise indicated, all references to halide percentages are based on silver present in the corresponding emulsion, grain, or grain region being discussed; e.g., a grain consisting of silver chlorobromide containing 60 mole percent chloride also contains 40 mole percent bromide.)

Wey, IMPROVED DOUBLE-JET PRECIPITATION PROCESSES AND PRODUCTS THEREOF, U.S. Ser. No. 429,403, filed concurrently herewith and commonly assigned, which is a continuation-in-part of U.S. Ser. No. 320,908, filed Nov. 12, 1981, now abandoned, discloses the preparation of tabular silver chloride grains which are substantially internally free of bromide and iodide. A higher proportion of nontabular grains and lower grain sizes are produced when tabular grain nucleation is undertaken in the presence of iodide. The tabular silver chloride grains are the products of an ammoniacal double-jet precipitation process. The tabular grains produced appear to have substantially parallel major crystals faces of primarily truncated triangular (typically irregular hexagonal) configuration. Both the major faces and the edges of the grains appear to lie entirely within {111} crystallographic planes. The average aspect ratio of the tabular grains is above 8:1.

E. Klein and E. Moisar, *Berichte der Bungesellschaft,* 67 (4), 349–355, 1963, reports an inhibiting effect upon the grain growth of silver chloride when purine bases, such as adenine, are added at various stages of emulsion precipitation. Halwig U.S. Pat. No. 3,519,426 discloses the preparation of silver chloride emulsions of increased covering power by precipitating in the presence of an azaindene, such as a tetraazaindene, pentaazaindene, or adenine. It is, of course, recognized that the covering power of silver halide emulsions of finer grain size is greater than that of silver halide emulsions of larger grain size, other features being comparable.

It is known in the art that silver halide grains can be precipitated in the presence of a variety of peptizers. Smith et al U.S. Pat. No. 3,415,653 discloses the precipitation of silver bromoiodide grains of a variety of shapes, including tabular, by employing a copolymer of vinylamine and acrylic acid as a peptizer. Smith et al U.S. Pat. No. 3,692,753 uses as a peptizer which can be coagulated and redispersed an interpolymer of at least three different monomers, one of which is an acrylamide or acrylate containing an appended alkyl chain containing one or two sulfur atoms substituted for linking alkyl carbons. Smith et al U.S. Pat. No. 3,615,624 discloses for use in peptizing silver chloride, a linear copolymer having recurring units of amides or esters of maleic, acrylic, or methacrylic acid in which the amine or alcohol condensation residue contains an organic radical having at least one sulfur atom linking two alkyl carbon atoms. In one investigation of neutral silver bromoiodide emulsions precipitated similarly to Example 5 of Smith et al U.S. Pat. No. 3,615,624 an emulsion was observed in which less than 20 percent of the projected area of the silver bromoiodide grains was accounted for by tabular grains. The tabular grains, though of low aspect ratio, appeared to have peripheral edges lying parallel to <211> crystallographic vectors lying in the plane of the major faces.

Wilgus and Haefner U.S. Ser. No. 429,420, filed concurrently herewith and commonly assigned, titled HIGH ASPECT RATIO SILVER BROMOIODIDE EMULSIONS AND PROCESSES FOR THEIR PREPARATION, which is a continuation-in-part of U.S. Ser. No. 320,905, filed Nov. 12, 1981, now abandoned, discloses high aspect ratio silver bromoiodide emulsions and a process for their preparation.

Kofron et al U.S. Ser. No. 429,407, filed concurrently herewith and commonly assigned, titled SENSITIZED HIGH ASPECT RATIO SILVER HALIDE EMULSIONS AND PHOTOGRAPHIC ELEMENTS, which is a continuation-in-part of U.S. Ser. No. 320,904, filed Nov. 12, 1981, now abandoned, discloses chemically and spectrally sensitized high aspect ratio tabular grain silver halide emulsions and photographic elements incorporating these emulsions.

Daubendiek and Strong U.S. Ser. No. 429,587, filed concurrently herewith and commonly assigned, titled AN IMPROVED PROCESS FOR THE PREPARATION OF HIGH ASPECT RATIO SILVER BROMOIODIDE EMULSIONS, which is a continuation-in-part of U.S. Ser. No. 320,906, filed Nov. 12, 1981, now abandoned, discloses an improvement on the processes of Maternaghan whereby high aspect ratio tabular grain silver bromoiodide emulsions can be prepared.

Abbott and Jones U.S. Ser. No. 430,222, filed concurrently herewith and commonly assigned, titled RADIOGRAPHIC ELEMENTS EXHIBITING REDUCED CROSSOVER, which is a continuation-in-part of U.S. Ser. No. 320,907, filed Nov. 12, 1981, now abandoned, discloses the use of high aspect ratio tabular grain silver halide emulsions in radiographic elements coated on both major surfaces of a radiation transmitting support to control crossover.

Solberg, Piggin, and Wilgus U.S. Ser. No. 431,913, filed concurrently herewith and commonly assigned, titled RADIATION-SENSITIVE SILVER BROMOIODIDE EMULSIONS, PHOTOGRAPHIC ELEMENTS, AND PROCESSES FOR THEIR USE, which is a continuation-in-part of U.S. Ser. No. 320,909, filed Nov. 12, 1981, now abandoned discloses high aspect ratio tabular grain silver bromoiodide emulsions wherein a higher concentration of iodide is present in an annular region than in a central region of the tabular grains.

Mignot U.S. Ser. No. 320,912, filed Nov. 12, 1981 and commonly assigned, titled SILVER BROMIDE EMULSIONS OF NARROW GRAIN SIZE DISTRIBUTION AND PROCESSES FOR THEIR PREPARATION discloses high aspect ratio tabular grain silver bromide emulsions wherein the tabular grains are square or rectangular in projected area.

Dickerson U.S. Ser. No. 430,574, filed concurrently herewith and commonly assigned, titled FOREHARDENED PHOTOGRAPHIC ELEMENTS AND PROCESSES FOR THEIR USE, which is a continuation-in-part of U.S. Ser. No. 320,910, filed Nov. 12, 1981, now abandoned discloses producing silver images of high covering power by employing photographic elements containing forehardened high aspect ratio tabular grain silver halide emulsions.

Jones and Hill U.S. Ser. No. 430,092, filed concurrently herewith and commonly assigned, titled PHOTOGRAPHIC IMAGE TRANSFER FILM UNIT, which is a continuation-in-part of U.S. Ser. No. 320,911, filed Nov. 12, 1981, now abandoned, discloses image transfer film units containing tabular grain silver halide emulsions.

Evans et al U.S. Ser. No. 431,912, filed concurrently herewith and commonly assigned, titled DIRECT REVERSAL EMULSIONS AND PHOTOGRAPHIC ELEMENTS USEFUL IN IMAGE TRANSFER FILMS which is a continuation-in-part of U.S. Ser. No. 320,891, filed Nov. 12, 1981, now abandoned, discloses image transfer film units containing tabular grain core-shell silver halide emulsions.

SUMMARY OF THE INVENTION

In one aspect this invention is directed to a radiation-sensitive photographic emulsion comprising a dispersing medium and silver halide grains the halide content of which is least 50 mole percent chloride based on silver. At least 50 percent of the total projected area of the silver halide grains is provided by tabular grains having a thickness of less than 0.5 micron, a diameter of at least 0.6 micron, and an average aspect ratio greater than 8:1. The tabular grains have two opposed, substantially parallel major crystal faces lying in {111} crystal planes and exhibit at least one of the following features: (1) at least one peripheral edge lying parallel to a <211> crystallographic vector lying in the plane of one of the major faces and (2) at least one of bromide and iodide incorporated in a central grain region.

In another aspect this invention is directed to an improvement in a process of preparing a radiation-sensitive photographic emulsion wherein aqueous silver and chloride-containing halide salt solutions are brought into contact in the presence of a dispersing medium to form silver halide grains the halide content of which is at least 50 mole percent chloride, based on silver. The improvement comprises reacting the aqueous silver and chloride-containing halide salt solutions in the presence of a crystal habit modifying amount of an aminoazaindene and a peptizer having a thioether linkage.

The present invention is directed to high aspect ratio tabular grain silver halide emulsions wherein the halide is predominantly chloride. In one preferred form the emulsions contain tabular grains of a configuration not previously known in the art. In another form the tabular grains are bounded entirely by {111} crystal faces and contain a different halide composition than has heretofore been attained with a combination of chloride and bromide halides. In an alternative form the tabular grains include edge faces which lie in differing crystallographic planes which provide a plurality of differing adsorption sites, thereby permitting competition for adsorption sites by differing addenda to be reduced. The improved emulsions of this invention can produce further photographic advantages, such as higher maximum density and higher covering power. As compared to the tabular grain silver chloride emulsions of Wey, cited above, the tabular grains of the invention can exhibit reduced thicknesses. They can also be formed of more uniform size and with a much lower proportion of nontabular grains than previously known tabular grains containing more than 50 mole percent chloride. Further, the tabular grains according to this invention can exhibit a much wider latitude with respect to the presence or absence of other halides. The emulsions of this invention can be precipitated at higher temperatures with lower tabular grain sizes resulting than encountered in forming tabular silver chloride emulsions by the technique of Wey. Further lower precipitation temperatures can be employed without encountering increases in peptizer viscosity characteristic of gelatin and gelatin-derivative peptizers. Finally, the present process does not require or preclude the presence of bromide, iodide, or ammonia, making the present process highly adaptable.

Still further, the advantages of the present invention can be realized in combination with the advantages disclosed by Kofron et al, cited above and here incorporated by reference, such as increased sharpness, increased separation of speeds in the native and spectrally sensitized regions of the spectrum, improved speed-granularity relationships, and increased speeds (or speed-granularity relationships) when blue sensitized. The advantages of the present invention can be realized still further in radiographic elements exhibiting relatively reduced crossover, as disclosed by Abbott et al, cited above and here incorporated by reference; in silver image forming photographic elements exhibiting increased covering power, as disclosed by Dickerson, cited above and here incorporated by reference; or in image transfer film units achieving a higher performance ratio of photographic speed to silver coverage (i.e., silver halide coated per unit area), faster access to a viewable transferred image, and higher contrast or transferreed images with less time of development, as disclosed by Jones et al, cited above and here incorporated by reference.

BRIEF DESCRIPTION OF THE DRAWINGS

FIGS. 1*a*, 2*a*, and 3 are plan views of individual silver halide grains;

FIG. 11A is a plot of relative log spectral sensitivity versus wavelength.

DESCRIPTION OF PREFERRED EMBODIMENTS

Figure 1A:
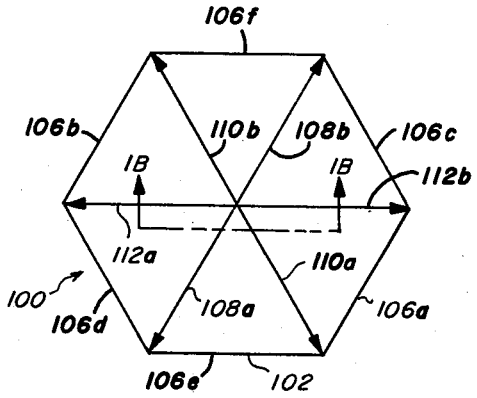

This invention relates to high aspect ratio tabular grain silver halide emulsions wherein chloride is the predominant halide on a mole basis, to processes for their preparation, to photographic elements which incorporate these emulsions, and to processes for the use of the photographic elements. As employed herein the term "high aspect ratio" is defined as requiring that tabular silver halide grains which contain chloride as the predominant halide having a thickness of less than 0.5 micron (preferably less than 0.3 micron) and a diameter of at least 0.6 micron have an average aspect ratio of greater than 8:1 and account for at least 50 percent of the total projected area of the predominantly chloride silver halide grains present in the emulsion. (All average aspect ratios and projected areas subsequently discussed are similarly determined, unless otherwise stated.)

The preferred high aspect ratio tabular grain silver halide emulsions of the present invention are those wherein the silver halide grains having a thickness of less than 0.5 micron (preferably 0.3 micron) and a diameter of at least 0.6 micron have an average aspect ratio of at least 12:1 and optimally at least 20:1. Extremely high average aspect ratios (50:1, 100:1, or more) can be obtained. In a preferred form of the invention these silver halide grains account for at least 70 percent and optimally at least 90 percent of the total projected area of the silver halide grains. It is appreciated that the thinner the tabular grains accounting for a given percentage of the projected area, the higher the average aspect ratio of the emulsion. Typically, the tabular grains have an average thickness of at least 0.15 micron, although even thinner tabular grains can in principal be employed—e.g., as low as 0.10 micron.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each grain and to identify those tabular grains having a thickness of less than 0.5 micron (or 0.3 micron) and a diameter of at least 0.6 micron. From this the aspect ratio of each such tabular grain can be calculated, and the aspect ratios of all the tabular grains in the sample meeting the thickness and diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.5 (or 0.3) micron and a diameter of at least 0.6 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the silver halide grains meeting the thickness and diameter criteria can be summed, the projected areas of the remaining silver halide grains in the photomicrograph can be summed separately, and from the two sums the percentage of the total projected area of the silver halide grains provided by the grains meeting the thickness and diameter criteria can be calculated.

In the above determinations a reference tabular grain thickness of less than 0.5 (or 0.3 micron) was chosen to distinguish the uniquely thin tabular grains herein contemplated from thicker tabular grains which provide inferior photographic properties. A reference grain diameter of 0.6 micron was chosen, since at lower diameters it is not always possible to distinguish tabular and nontabular grains in micrographs. The term "projected area" is used in the same sense as the terms "projection area" and "projective area" commonly employed in the art; see, for example, James and Higgins, *Fundamentals of Photographic Theory,* Morgan and Morgan, New York, p. 15.

Figure 1B:
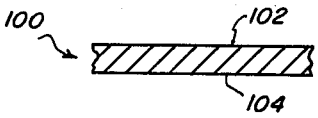
FIG. 1*b* is a sectional detail taken along section line 1*b*—1*b* in FIG. 1*a;*

The radiation-sensitive photographic emulsions of the present invention in one preferred form contain tabular grains of novel configuration. A typical grain configuration is schematically illustrated in FIGS. 1*a* and 1*b*. The grain 100 shown has opposed, substantially parallel major faces 102 and 104. Viewed in plan, as in a photomicrograph, the major faces appear as regular hexagons bounded by edge surfaces 106*a, b, c, d, e,* and *f*. The edge surfaces that have been viewed in electron micrographs appear planar. Crystallographic investigation has revealed that the major faces of the grains each lie in a {111} crystallographic plane.

The <221> crystallographic vectors 108*a,* 108*b,* 110*a,* 110*b,* 112*a,* and 112*b* shown in FIG. 1A to intersect at 60° angles lie in the plane of the major face 102. In the grain 100, each of the six edge surfaces are shown to lie parallel to one of the <221> crystallographic vectors. Edge surfaces 106*a* and 106*b* lie parallel to the vector 108, edge surfaces 106*c* and 106*d* lie parallel to the vector 110, and edge surfaces 106*e* and 106*f* lie parallel to the vector 112. These edge surfaces are believed to lie in {110} crystallographic planes, sometimes alternatively designated {220} crystallographic planes.

Figure 2A:
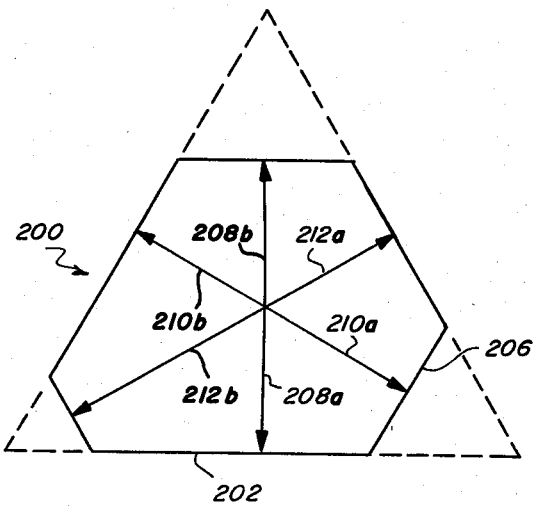
Figure 2B:
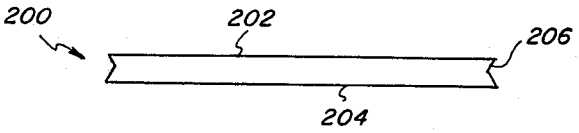
FIG. 2*b* is an edge view of a silver halide grain.

The unique crystallographic structure of the tabular grains of this invention can be better appreciated by reference to FIGS. 2*a* and 2*b,* which provide a schematic depiction of a typical tabular silver chloride grain produced by the process of Wey, described above. Crystallographic investigation suggests that not only the major faces 202 and 204, but also the edge surfaces 206, lie in {111} crystallographic planes. The edge surfaces do not appear to be planar. Thus, in terms of face and edge orientations, the tabular silver chloride grains of Wey appear similar to those in many published studies of silver bromide and bromoiodide tabular and sheet crystals. As viewed in plan, the grains do not appear as regular hexagons. Rather, they are typically irregular hexagons and can be viewed, as suggested by the dashed lines, as truncated equilateral triangles. From crystallographic investigation it appears that none of the <221> crystallographic vectors 208*a,* 208*b,* 210*a,* 210*b,* 212*a,* and 212*b,* which intersect at 60° angles, is parallel to the edges 206. Thus, the edge surfaces of the tabular grains of this invention can be viewed as being rotated 30° with respect to the crystal lattice as compared to those of the tabular grains of Wey and similar tabular silver bromide and bromoiodide grains.

Although tabular grains which appear in photomicrographs as regular hexagons can be prepared according to this invention, other peripheral configurations have also been produced and observed. This is schematically illustrated by the grain 300 in FIG. 3. Instead of having six edges, the grains appear to have six edges 306*a* alternated with six edges 306*b,* or a total of twelve edges. Thus, the grains can appear as dodecagons when viewed in plan. As suggested by the dashed lines, the six additional edges are believed to result from truncation of the hexagonal grains in their final stages of growth. Since a circle can be viewed as the limiting case of a regular polygon as it approaches an infinite number of sides, it is not surprising that the dodecagons to a much larger extent than the hexagons appear in photomicrographs more rounded, particularly at the intersections of their edges. The tabular grains of the present invention in one preferred form can include very distinct and regular hexagonal configurations, almost circular edge configurations in which flat edge segments are not readily visually identifiable, and all intermediate configurations. The tabular grains of this invention in one preferred form can be characterized as having in each occurrence at least one edge which is parallel to a <211> crystallographic vector in the plane of one of its major faces.

The chloride-containing tabular emulsions prepared according to the present invention contain as a portion of the dispersing medium, as formed, a peptizer containing a thioether linkage. The thioether linkage containing peptizer is present in the emulsion at the conclusion of precipitation in a concentration of from about 0.1 to 10 percent by weight, based on total weight. The peptizer can be initially entirely present in the reaction vessel in which grain precipitation occurs or can be run into the reaction vessel concurrently with the silver and halide salts through the same or separate jets, provided at least the minimum stated concentration is present in the reaction vessel during initial nucleation and continued growth of the tabular grains. it is preferred that the concentration of the thioether linkage containing peptizer in the reaction vessel be within the range of from 0.3 to 6 percent, optimally 0.5 to 2.0 percent, based on the total weight of the contents of the reaction vessel.

During or, preferably, after precipitation it is possible to supplement the thioether linkage containing peptizer with any conventional peptizer to produce total peptizer concentrations of up to about 10 percent by weight, based on total weight. The thioether linkage containing peptizer is at least partially adsorbed to the surfaces of the tabular grains and is not readily entirely displaced once the emulsion is formed in its presence. Nevertheless, it is possible to reduce the concentration of the peptizer by conventional washing techniques after the emulsion is fully formed so that in the final emulsion very little, if any, of the original thioether linkage containing peptizer remains.

Conventional silver halide peptizers containing thioether linkages can be employed in the practice of the invention. Specifically preferred peptizers containing thioether linkages are those disclosed by Smith et al U.S. Pat. Nos. 3,615,624 and 3,692,753, cited above and here incorporated by reference. These peptizers are preferably water-soluble linear copolymers comprising (1) recurring units in the linear polymer chain of amides or esters of maleic, acrylic, or methacrylic acids in which respective amine or alcohol condensation residues in the respective amides and esters contain an organic radical having at least one sulfide-sulfur atom linking two alkyl carbon atoms and (2) units of at least one other ethylenically unsaturated monomer. The latter repeating units include typically at least one group capable of imparting water solubility to the monomer at the pH levels of precipitation. For example, such units can be similar to recurring units (1) above, except that sulfonic acid or sulfonic acid salt substituted alkyl groups replace the thioether groups containing the sulfide-sulfur atoms linking two alkyl carbon atoms. Units of this type are further disclosed in Chen U.S. Pat. No. 3,615,624. The thioether linkage containing repeating units preferably comprise from about 2.5 to 35 mole percent, optimally from about 5 to 25 mole percent, of the peptizer.

Chloride-containing tabular grains according to the present invention are not formed in the absence of the thioether linkage containing peptizer. Further, they are not formed in the presence of the thioether linkage containing peptizer, unless a small amount of crystal modifier is also present. The preferred crystal modifier is an aminoazaindene, although in some instances high aspect ratio tabular grain emulsions according to this invention can be obtained by relying on iodide as a crystal modifier, more fully discussed in connection with Emulsion 28. As herein defined an aminoazaindene is an azaindene having as a ring substituent an amino group bonded to the ring at the amino nitrogen atom. As is generally appreciated, azaindenes are compounds having the aromatic ring structure of an indene, but with one or more of the rig carbon atoms replaced by nitrogen atoms. Such compounds, particularly those having three to five carbon atoms replaced with nitrogen atoms, have found utility in photographic emulsions as grain growth modifiers, antifoggants, and stabilizers. Specifically preferred aminoazaindenes for use in the practice of this invention are those having a primary amino substituent attached to a ring carbon atom of a tetraazaindene, such as adenine and guanine, also referred to an aminopurines. While the aminoazaindenes can be used in any grain growth modifying amount, very small concentrations of as little as $10^{-3}$ mole per mole of silver are effective. Useful concentrations can range as high as 0.1 mole per mole of silver. It is generally preferred to maintain from about $0.5\times10^{-2}$ to $5\times10^{-2}$ mole of aminoazaindene per mole of silver in the reaction vessel during silver halide precipitation. Specific aminoazaindenes known to be useful in photographic emulsions as stabilizers are illustrated by Heimbach et al U.S. Pat. No. 2,444,605 and Allen et al U.S. Pat. Nos. 2,743,181 and 2,772,164. Once the emulsion is formed the aminoazaindene is no longer required, but at least a portion typically remains adsorbed to the grain surfaces. Compounds which show a strong affinity for silver halide grain surfaces, such as spectral sensitizing dyes, may displace the aminoazaindene, permitting the azaindene to be substantially entirely removed from the emulsion by washing.

It is believed that the aminoazaindene and the thioether linkage containing peptizer work in combination to provide the desired tabular grain properties sought. It has been observed in some instances that at an early stage of grain formation the tabular grains have not only {111} major crystal faces, but also {111} edges. As precipitation progresses a transition has been observed to dodecagon major crystal faces. Finally, as precipitation further progresses the tabular grains can be produced having regular hexagon {111} major crystal faces and peripheral edges lying parallel to <211> crystallographic vectors lying in the plane of one of the major surfaces, which is believed to be indicative of edges lying in {110} crystal planes.

Without intending to be bound by any particular theory to account for the unique features of the tabular grains produced by the present invention, it is believed that the aminoazaindene influences the predominantly chloride grains at the nucleation stage to favor the formation of {111} crystal faces. The {111} crystal faces in turn are believed to permit the formation of double twin planes, which are regarded in the art as accounting for the formation of tabular grains. It is believed that the peptizer containing a thioether linkage thereafter, during grain growth, causes a transition to occur which accounts for the unique tabular grain edges observed. This view of the mechanism of grain formation has been corroborated by viewing the grains at various stages of growth and by adjusting levels of aminoazaindene. Increasing the concentration of aminoazaindene has been observed to delay and in some instances preclude the formation of the unique grain edges, although fully satisfactory grains having {111} crystal edges are obtained.

When tabular grain emulsions according to the present invention are precipitated in the initial absence of halide other than chloride, the central regions of the grains produced are substantially free of both bromide and iodide, and the presence of one or more grain edges lying parallel to one or more <211> crystallographic vectors lying in the plane of one of the major surfaces provides a convenient structural difference for distinguishing the tabular grains of the present invention from those of Wey, cited above. Additionally the tabular grains consisting essentially of silver chloride in a central grain region can be distinguished over the tabular grains of Wey by other features, such as lower average grain thickness, the presence of aminoazaindene, or thioether linkage containing peptizer, depending upon the specific embodiment considered. When precipitation of tabular grains consisting essentially of silver chloride is undertaken so that the grain edges lie entirely in {111} crystallographic planes, the process of the invention can be employed to produce tabular grains similar to those produced by the process of Wey, although at least initially differing by one or more of the secondary features identified above.

In one preferred form of the invention the tabular grains produced can differ from those of Wey, cited above, by the halide content of the central region of the grain. Specifically, it is contemplated that at least the central region of the tabular grains of this invention be at least 50 mole percent chloride, based on silver, but, unlike the tabular grains of Wey, can additionally contain substantial quantities of at least one of bromide and iodide. Significant photographic effects can be achieved with bromide and/or iodide concentrations as low as 0.05 mole percent, although if bromide and/or iodide are present, they are usually present in concentrations of at least about 0.5 mole percent.

The tabular grains can also contain up to about 10 mole percent iodide, preferably up to 6 mole percent iodide, optimally up to 2 mole percent iodide. The remainder of the halide in addition to chloride and iodide, if present, can be bromide. In a preferred form of the invention the tabular grains are greater than 75 mole percent chloride, optimally greater than 90 mole percent chloride, based on silver. Tabular grains which consist essentially of silver chloride are specifically contemplated and are particularly advantageous for applications in which silver chloride emulsions are conventionally employed. It is a specific advantage of the present invention that substantial quantities of bromide and/or iodide can be incorporated into the tabular grains without adversely affecting their tubular configuration, thereby permitting the tabular grains to serve better a variety of photographic applications optimally requiring different halides.

At the outset of emulsion precipitation at least a portion of the dispersing medium containing the peptizer and crystal modifier, as discussed above, are present in a reaction vessel containing an efficient stirring mechanism. Typically the dispersing medium initially introduced into the reaction vessel is at least about 10 percent, preferably 20 to 100 percent, by weight based on total weight of the dispersing medium present in the emulsion at the conclusion of grain precipitation. Since dispersing medium can be removed from the reaction vessel by ultrafiltration during grain precipitation, as taught by Mignot U.S. Pat. No. 4,334,012, here incorporated by reference, it is appreciated that the volume of dispersing medium initially present in the reaction vessel can equal or even exceed the volume of the emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

During precipitation the pH within the reaction vessel is maintained on the acid side of neutrality. Optimum pH levels are influenced by the growth modifier and temperature chosen for precipitation. Within the temperature range of from 20° to 90° C. useful pH values occur within the range of from 2 to 5.0. Precipitation is preferably undertaken at temperatures within the range of from 40° to 90° C. at pH values in the range of from about 2.5 to 3.5. During precipitation chloride ion concentrations in the reaction vessel are also controlled. Generally useful chloride ion concentrations within the reaction vessel are from about 0.1 to 5.0 molar. Preferred chloride ion concentrations are in the range of from about 0.5 to 3.0 molar. The proportion of other halides incorporated in the tabular grain can be controlled by adjusting the ratio of chloride to other halide salts introduced. Halide ion concentrations in the reaction vessel can be monitored by measuring pAg.

Once tabular grains the halide of which is predominantly chloride have been formed according to the process of the present invention, other halides can be incorporated into the grains by procedures well known to those skilled in the art. Techniques for forming silver salt shells are illustrated by Berriman U.S. Pat. No. 3,367,778, Porter et al U.S. Pat. Nos. 3,206,313 and 3,317,322, Morgan U.S. Pat. No. 3,917,485, and Maternaghan, cited above. Since conventional techniques for shelling do not favor the formation of high aspect ratio tabular grains, as shell growth proceeds the average aspect ratio of the emulsion declines. If conditions favorable for tabular grain formation are present in the reaction vessel during shell formation, shell growth can occur preferentially on the outer edges of the grains so that aspect ratio need not decline. Wey and Wilgus, cited above and here incorporated by reference, specifically teach procedures for shelling tabular grains without necessarily reducing the aspect ratios of the resulting core-shell grains as compared to the tabular grains employed as core grains. Evans, Daubendiek, and Raleigh, cited above and here incorporated by reference, specifically discloses the preparation of high aspect ratio core-shell tabular grain emulsions for use in forming direct reversal images.

By adding both halide and silver salts after the silver chloride tabular grains are formed, the original grains remain intact, but serve as nuclei for the deposition of additional silver halide. If salts which are capable of reaction with silver to form silver salts less soluble than silver chloride, such as thiocyanate, bromide, and/or iodide salts, are added to the emulsion containing tabular predominantly chloride grains without the addition of silver salt, they will displace chloride in the crystal structure. Displacement begins at the crystal surfaces and progresses toward the interior of the grains. The substitution of chloride ions in the silver chloride crystal lattice with bromide ions and, optionally, a major proportion of iodide ions is well known. Such emulsions are referred to in the art as halide-converted silver halide emulsions. Techniques for preparing halide-converted emulsions and uses therefor are illustrated by Knott et al U.S. Pat. No. 2,456,953, Davey et al U.S. Pat. No. 2,592,250. MacWilliam U.S. Pat. No. 2,756,148, and Evans U.S. Pat. No. 3,622,318. In the present invention less than 20 mole percent, preferably less than 10 percent, of the halide is introduced by displacement. At high levels of displacement the tabular configuration of the grains is degraded or even destroyed. Thus, while substitution of bromide and/or iodide ions for chloride ions at or near the grain surfaces is contemplated, massive halide conversions, as are common in producing internal latent image forming grains, are not contemplated in the practice of this invention.

In the formation of tabular silver chloride grains according to this invention an aqueous dispersing medium is placed in a conventional silver halide reaction vessel. The pH and pAg of the dispersing medium within the reaction vessel are adjusted to satisfy the conditions of precipitation according to this invention. Since the ranges of pAg values contemplated for use in the practice of this invention are on the halide side of the equivalence point (the pAg at which the concentration of silver and halide ions are stoichiometrically equal), aqueous chloride salt solution is employed to adjust pAg initially. Thereafter, an aqueous silver salt solution and aqueous chloride salt solution are concurrently run into the reaction vessel. The pAg within the reaction vessel is maintained within the desired limited by conventional measurement techniques and by adjusting the relative flow rates of the silver and chloride salt solutions. Using conventional sensing techniques, the pH in the reaction vessel is also monitored and is maintained within a predetermined range by the addition of a base while the silver and chloride salts are being introduced. Apparatus and techniques for controlling pAg and pH during silver halide precipitation are disclosed by Oliver U.S. Pat. No. 3,031,304, Culhane et al U.S. Pat. No. 3,821, 002, and Claes and Peelaers, *Photographische Korrespondenz,* 103, 161 (1967). (As herein employed, pAg, pBr, and pH are defined as the negative logarithm of silver, bromide, and hydrogen ion concentration, respectively.)

The individual silver and halide salts can be added to the reaction vessel through surface or subsurface delivery tubes by gravity feed or by delivery apparatus for maintaining control of the rate of delivery and the pH and/or pAg of the reaction vessel contents, as illustrated by Culhane et al U.S. Pat. No. 3,821,002, Oliver U.S. Pat. No. 3,031,304 and Claes et al, *Photographische Korrespondenz,* Band 102, Number 10, 1967, p. 162. In order to obtain rapid distribution of the reactants within the reaction vessel, specially contructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. patent application No. 2,022,431A, Saito et al German OLS Nos. 2,555,364and 2,556,885, and *Research Disclosure,* Volume 166, February 1978, Item 16662. *Research Disclosure* and its predecessor, *Product Licensing Index,* are publications of Industrial Opportunities Ltd.; Homewell, Havant; Hampshire, P09 1EF, United Kingdom.

Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European patent application No. 80102242, and Wey "Growth Mechanism of AgBr Crystals in Gelatin Solution", *Photographic Science and Engineering,* Vol. 21, No. 1, January/February 1977, p. 14, et. seq. By voiding the formation of additional grain nuclei after passing into the growth stage of precipitation, relatively monodispersed tabular silver halide grain populations can be obtained. Emulsions having coefficients of variation of less than about 30 percent can be prepared employing the process of the present invention. (As employed herein the coefficient of variation, is defined as 100 times the standard deviation of the grain diameter divided by the average grain diameter.) By intentionally favoring renucleation during the growth stage of precipitation, it is, of course, possible to produce polydispersed emulsions of substantially higher coefficients of variation.

Except as specifically described above, the process of preparing a tabular grain emulsion the halide content of which is predominantly chloride can take various conventional forms. The aqueous silver salt solution can employ a soluble silver salt, such as silver nitrate, while the aqueous halide salt solution can employ one or more water soluble ammonium, alkali metal (e.g., lithium, sodium, or potassium), or alkaline earth metal (e.g., magnesium or calcium) halide salts. The aqueous silver and halide salt solutions can vary widely in concentrations, ranging from 0.2 to 7.0 molar or even higher.

In addition to running silver and halide salts into the reaction vessel, a variety of other compounds are known to be useful when present in the reaction vessel during silver halide precipitation. For example, minor concentrations of compounds of metals such as copper, thallium, lead, bismuth, cadmium, zinc, middle chalocogens (i.e., sulfur, selenium, and tellurium), gold, and Group VIII noble metals, can be present during precipitation of the silver halide emulsion, as illustrated by Arnold et al U.S. Pat. No. 1,195,432, Hochstetter U.S. Pat. No. 1,951,933, Trivelli et al U.S. Pat. No. 2,448,060. Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure,* Vol. 134, June 1975. Item 13452. Distribution of the metal dopants in the silver chloride grains can be controlled by selective placement of the metal compounds in the reaction vessel or by controlled addition during the introduction of silver and chloride salts. The tabular grain emulsions can be internally reduction sensitized during precipitation, as illustrated by Moisar et al, *Journal of Photographic Science,* Vol. 25, 1977, pp. 19–27.

In forming the tabular grain silver chloride emulsions peptizer concentrations of from 0.2 to about 10 percent by weight, based on the total weight of emulsion components in the reaction vessel, can be employed. It is common practice to maintain the concentration of the peptizer in the reaction vessel below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 1 to 50 grams of peptizer per mole of silver halide, preferably about 2.5 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) in addition to the peptizer containing thioether linkages described above can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. Nos. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. Nos. 3,425,836, Smith et al U.S. Pat. Nos. 2,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of emulsions according to the present invention. Silver chloride, by reason of its higher level of solubility, is influenced to a lesser extent than other silver halides by the absence of ripening agents. Known silver halide solvents are useful in promoting ripening. For example, ripening agents can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Ripening agents can also be introduced during a separate step following introduction of the silver and halide salts.

The tabular grain high aspect ratio emulsions of the present invention are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No.

1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pp. 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular grains after the completion of precipitation to avoid increasing their thickness and reducing their aspect ratio.

Although the procedures for preparing tabular silver halide grains described above will produce high aspect ratio tabular grain emulsions in which the tabular grains satisfying the thickness and diameter criteria for aspect ratio account for at least 50 percent of the total projected area of the total silver halide grain population, it is recognized that advantages can be realized by increasing the proportion of such tabular grains present. Preferably at least 70 percent (optimally at least 90 percent) of the total projected area is provided by tabular silver halide grains meeting the thickness and diameter criteria. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al U.S. Pat. No. 3,326,641.

The high aspect ratio tabular grain silver halide emulsions of the present invention can be conventionally chemically sensitized or chemically sensitized as taught by Kofron et al, cited above. They can be chemically sensitized with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April 1974, Item 12008, *Research Disclosure,* Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, as described in Damschroder U.S. Pat. No. 2,642,316; sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, bennzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Pat. No. 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure,* Vol. 136, August 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

Although the high aspect ratio tabular grain silver halide emulsions of the present invention are generally responsive to the techniques for chemical sensitization known in the art in a qualitative sense, in a quantitative sense—that is, in terms of the actual speed increases realized—the tabular grain emulsions require careful investigation to identify the optimum chemical sensitization for each individual emulsion, certain preferred embodiments being more specifically discussed below.

In addition to being chemically sensitized the high aspect ratio tabular grain silver chloride emulsions of the present invention are also spectrally sensitized. It is specifically contemplated to employ spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The emulsions of this invention can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolinium, thiazolium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also funtion as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. F. Large, *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964, (No. Re 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. Nos. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto-substituted heterocycles, as taught by Riester U.S. Pat. No. 3,457,078; bromide or iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.,* Vol. 56, p. 1065, 1952; Spence et al, "Desensitization of Sensitizing Dyes", *Journal of Physical and Colloid Chemistry,* Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process,* 1942, Macmillan, pp. 1067–1069.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure,* Vol. 181, May 1979, Item 18155.

In one preferred form, spectral sensitizers can be incorporated in the emulsions of the present invention prior to chemical sensitization. Similar results have also been achieved in some instances by introducing other adsorbable materials, such as finish modifiers, into the emulsions prior to chemical sensitization.

Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,642,361, cited above. Other ripening agents can be used during chemical sensitization.

In still a third approach, which can be practiced in combination with one or both of the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide, iodide, and/or chloride) grains capable of Ostwald ripening onto the tabular grain surfaces can be introduced. For example, a Lippmann emulsion can be introduced during chemical sensitization. Maskasky U.S. Ser. No. 431,855, filed concurrently herewith and commonly assigned, titled CONTROLLED SITE EPITAXIAL SENSITIZATION, which is a continuation-in-part of U.S. Ser. No. 320,920, filed Nov. 12, 1981, now abandoned both of which are here incorporated by reference, discloses the chemical sensitization of spectrally sensitized high aspect ratio tabular grain emulsions at one or more ordered discrete sites of the tabular grains. In one preferred form the preferential absorption of spectral sensitizing dye on the crystallographic surfaces forming the major faces of the tabular grains allows chemical sensitization to occur at selected crystallographic surfaces of the tabular grains.

Although not required to realize all of their advantages, the emulsions of the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1-log E), where E is measured in meter-candle-seconds at a density of 0.3 above fog. Once the silver halide grains of an emulsion have been characterized it is possible to estimate from further product analysis and performance evaluation whether an emulsion layer of a product appears to be substantially optimally chemically and spectrally sensitized in relation to comparable commercial offerings of other manufacturers. To achieve the sharpness advantages of the present invention it is immaterial whether the silver halide emulsions are chemically or spectrally sensitized efficiently or inefficiently.

Once high aspect ratio tabular grain emulsions have been generated by precipitation procedures, washed, and sensitized, as described above, their preparation can be completed by the incorporation of conventional photographic addenda, and they can be usefully applied to photographic applications requiring a silver image to be produced—e.g., conventional black-and-white photography.

Dickerson, cited above and here incorporated by reference, discloses that hardening photographic elements according to the present invention intended to form silver images to an extent sufficient to obviate the necessity of incorporating additional hardener during processing permits increased silver covering power to be realized as compared to photographic elements similarly hardened and processed, but employing nontabular or less than high aspect ratio tabular grain emulsions. Specifically, it is taught to harden the high aspect ratio tabular grain emulsion layers and other hydrophilic colloid layers of black-and-white photographic elements in an amount sufficient to reduce swelling of the layers to less than 200 percent, percent swelling being determined by (a) incubating the photographic element at 38° C. for 3 days at 50 percent relative humidity, (b) measuring layer thickness, (c) immersing the photographic element in distilled water at 21° C. for 3 minutes, and (d) measuring change in layer thickness. Although hardening of the photographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing or radiographic materials.

Typical useful incorporated hardeners (forehardeners) include formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al U.S. Pat. No. 3,819,608; α-diketones, as illustrated by Allen et al U.S. Pat. No. 2,725,305; active esters of the type described by Burness et al U.S. Pat. No. 3,542,558; sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Pat. No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active vinyl groups (e.g. vinylsulfonyl groups), as illustrated by Burness et al U.S. Pat. Nos. 3,490,911, 3,539,644 and 3,841,872 (No. Re 29,305), Cohen U.S. Pat. No. 3,640,720, Kleist et al German Pat. No. 872,153 and Allen U.S. Pat. No. 2,992,109; blocked active olefins, as illustrated by Burness et al U.S. Pat. No. 3,360,372 and Wilson U.S. Pat. No. 3,345,177; carbodiimides, as illustrated by Blout et al German Pat. No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acrolein-methacrylic acid), as illustrated by Himmelmann et al U.S. Pat. No. 3,396,029.

The use of forehardeners in combination is illustrated by Sieg et al U.S. Pat. No. 3,497,358, Dallon et al U.S. Pat. Nos. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Pat. No. 881,444, Riebel et al U.S. Pat. No. 3,628,961 and Ugi et al U.S. Pat. No. 3,901,708. The patents illustrative of hardeners and hardener combinations are here incorporated by reference.

Instability which increases minimum density in negative type emulsion coatings (i.e., fog) or which increases minimum density or decreases maximum density in direct-positive emulsion coatings can be protected against by incorporation of stabilizers, antifoggants, antikinking agents, latent image stabilizers and similar addenda in the emulsion and contiguous layers prior to coating. Many of the antifoggants which are effective in emulsions can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings stabilizers and antifoggants can be employed, such as halide ions (e.g., chloride salts); chloropalladates and chloropalladites, as illustrated by Trivelli et al U.S. Pat. No. 2,566,263; water-soluble inorganic salts of magnesium, calcium, cadmium, cobalt, manganese and zinc, as illustrated by Jones U.S. Pat. No. 2,839,405 and Sidebotham U.S. Pat. No. 3,488,709; mercury salts, as illustrated by Allen et al U.S. Pat. No. 2,728,663; selenols and diselenides, as illustrated by Brown et al U.K. Pat. No. 1,336,570 and Pollet et al U.K. Pat. No. 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes, as illustrated by Thiers et al U.S. Pat. No. 3,630,744; isothiourea derivatives, as illustrated by Herz et al U.S. Pat. No. 3,220,839 and Knott et al U.S. Pat. No. 2,514,650; thiazolidines, as illustrated by Scavron U.S. Pat. No. 3,565,625; peptide derivatives, as illustrated by Maffet U.S. Pat. No. 3,274,002; pyrimidines and 3-pyrazolidones, as illustrated by Welsh U.S. Pat. No. 3,161,515 and Hood et al U.S. Pat. No. 2,751,297; azotriazoles and azotetrazoles, as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure,* Vol. 134, June 1975, Item 13452, and Vol. 148, August 1976, Item 14851, and Nepker et al U.K. Pat No. 1,338,567; mercaptotetrazoles, -triazoles and -diazoles, as illustrated by Kendall et al U.S. Pat. No. 2,403,927, Kennard et al U.S. Pat. No. 3,266,897, *Research Disclosure,* Vol. 116, December 1973, Item 11684, Luckey et al U.S. Pat. No. 3,397,987 and Salesin U.S. Pat. No. 3,708,303; azoles, as illustrated by Peterson et al U.S. Pat. No. 2,271,229 and *Research Disclosure,* Item 11684, cited above; purines, as illustrated by Sheppard et al U.S. Pat. No. 2,319,090, Birr et al U.S. Pat. No. 2,152,460, *Research Disclosure,* Item 13452, cited above, and Dostes et al French Pat. No. 2,296,204 and polymers of 1,3-dihydroxy(and/or 1,3-carbamoxy)-2-methylenepropane, as illustrated by Saleck et al U.S. Pat. No. 3,926,635.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Pat. No. 1,466,024 and Habu et al U.S. Pat. No. 3,929,486; quaternary ammonium salts of the type illustrated by Piper U.S. Pat. No. 2,886,437; water-insoluble hydroxides, as illustrated by Maffet U.S. Pat. No. 2,953,455; phenols, as illustrated by Smith U.S. Pat. Nos. 2,955,037 and '038; ethylene diurea, as illustrated by Dersch U.S. Pat. No. 3,582,346; barbituric acid derivatives, as illustrated by Wood U.S. Pat. No. 3,617,290; boranes, as illustrated by Bigelow U.S. Pat. No. 3,725,078; 3-pyrazolidinones, as illustrated by Wood U.K. Pat. No. 1,158,059 and aldoximines, amides, anilides and esters, as illustrated by Butler et al U.K. Pat. No. 988,052.

The emulsions can be protected from fog and desensitization caused by trace amounts of metals such as copper, lead, tin, iron and the like, by incorporating addenda, such as sulfocatechol-type compounds, as illustrated by Kennard et al U.S. Pat. No. 3,236,652; aldoximines, as illustrated by Carroll et al U.K. Pat. No. 623,448 and meta- and poly-phosphates, as illustrated by Draisbach U.S. Pat. No. 2,239,284, and carboxylic acids such as ethylenediamine tetraacetic acid, as illustrated by U.K. Pat. No. 691,715.

Among stabilizers useful in layers containing synthetic polymers of the type employed as vehicles and to improve covering power are monohydric and polyhydric phenols, as illustrated by Forsgard U.S. Pat. No. 3,043,697; saccharides, as illustrated by U.K. Pat. No. 897,497 and Stevens et al U.K. Pat. No. 1,039,471 and quinoline derivatives, as illustrated by Dersch et al U.S. Pat. No. 3,446,618.

Among stabilizers useful in protecting the emulsion layers against dichroic fog are addenda, such as salts of nitron, as illustrated by Barbier et al U.S. Pat. Nos. 3,679,424 and 3,820,998; mercaptocarboxylic acids, as illustrated by Willems et al U.S. Pat. No. 3,600,178, and addenda listed by E. J. Birr, *Stabilization of Photographic Silver Halide Emulsions,* Focal Press, London, 1974, pp. 126–218.

Among stabilizers useful in protecting emulsion layers against development fog are addenda such as azabenzimidazoles, as illustrated by Bloom et al U.K. Pat. No. 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like, as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives, as illustrated by Herz et al U.S. Pat. No. 3,220,839, and thiodiazole derivatives, as illustrated by von Konig U.S. Pat. No. 3,364,028 and von Konig et al U.K. Pat. No. 1,186,441.

Where hardeners of the aldehyde type are employed, the emulsion layers can be protected with antifoggants, such as monohydric and polyhydric phenols of the type illustrated by Sheppard et al U.S. Pat. No. 2,165,421; nitro-substituted compounds of the type disclosed by Rees et al U.K. Pat. No. 1,269,268; poly(alkylene oxides), as illustrated by Valbusa U.K. Pat. No. 1,151,914, and mucohalogenic acids in combination with urazoles, as illustrated by Allen et al U.S. Pat. Nos. 3,232,761 and 3,232,764, or further in combination with maleic acid hydrazide, as illustrated by Rees et al U.S. Pat. No. 3,295,980.

To protect emulsion layers coated on linear polyester supports addenda can be employed such as parabanic acid, hydantoin acid hydrazides and urazoles, as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate, as illustrated by Overman U.S. Pat. No. 2,628,167; compounds, polymeric latices and dispersions of the type disclosed by Jones et al U.S. Pat. No. 2,759,821 and '822; azole and mercaptotetrazole hydrophilic colloid dispersions of the type disclosed by *Research Disclosure,* Vol. 116, December 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide), as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions, as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure,* Vol. 99, July 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent image fading, latent image stabilizers can be incorporated, such as amino acids, as illustrated by Ezekiel U.K. Pat. Nos. 1,335,923, 1,378,354, 1,387,654 and 1,391,672, Ezekiel et al U.K. Pat. No. 1,394,371, Jefferson U.S. Pat. No. 3,843,372, Jefferson et al U.K. Pat. No. 1,412,294 and Thurston U.K. Pat. No. 1,343,904; carbonyl-bisulfite addition products in combination with hydroxybenzene or aromatic amine developing agents, as illustrated by Seiter et al U.S. Pat. No. 3,424,583; cycloalkyl-1,3-diones, as illustrated by Beckett et al U.S. Pat. No. 3,447,926; enzymes of the catalase type, as illustrated by Matejec et al U.S. Pat. No. 3,600,182; halogen-substituted hardeners in combination with certain cyanine dyes, as illustrated by Kumai et al U.S. Pat. No. 3,881,933; hydrazides, as illustrated by Honig et al U.S. Pat. No. 3,386,831; alkenylbenzothiazolium salts, as illustrated by Arai et al U.S. Pat. No. 3,954,478; soluble and sparingly soluble mercaptides, as illustrated by Herz U.S. Pat. No. 4,374,196, commonly assigned annd here incorporated by reference; hydroxy-substituted benzylidene derivatives, as illustrated by Thurston U.K. Pat. No. 1,308,777 and Ezekiel et al U.K. Pat. Nos. 1,347,544 and 1,353,527; mercapto-substituted compounds of the type disclosed by Sutherns U.S. Pat. Nos. 3,519,427; metal-organic complexes of the type disclosed by Matejec et al U.S. Pat. No. 3,639,128; penicillin derivatives, as illustrated by Ezekiel U.K. Pat. No. 1,389,089; propynylthio derivatives of benzimidazoles, pyrimidines, etc., as illustrated by von Konig et al U.S. Pat. No. 3,910,791; combinations of iridium and rhodium compounds, as disclosed by Yamasue et al U.S. Pat. No. 3,901,713; sydnones or sydnone imines, as illustrated by Noda et al U.S. Pat. No. 3,881,939; thiazolidine derivatives, as illustrated by Ezekiel U.K. Pat. No. 1,458,197 and thioether-substituted imidazoles, as illustrated by *Research Disclosure,* Vol. 136, August 1975, Item 13651.

In addition to sensitizers, hardeners, and antifoggants and stabilizers, a variety of other conventional photographic addenda can be present. The specific choice of addenda depends upon the exact nature of the photographic application and is well within the capability of the art. A variety of useful addenda is disclosed in *Research Disclosure,* Vol. 176, December 1978, Item 17643, here incorporated by reference. Optical brighteners can be introduced, as disclosed by Item 17643 at Paragraph V. Absorbing and scattering materials can be employed in the emulsions of the invention and in separate layers of the photographic elements, as described in Paragraph VIII. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. When the photographic elements of the invention are intended to serve radiographic applications, emulsion and other layers of the radiographic element can take any of the forms specifically described in *Research Disclosure,* Item 18431, cited above, here incorporated by reference. The emulsions of the invention, as well as other, conventional silver halide emulsion layers, interlayers, overcoats, and subbing layers, if any, present in the photographic elements can be coated and dried as described in Item 17643, Paragraph XV.

In accordance with established practices within the art it is specifically contemplated to blend the high aspect ratio tabular grain emulsions of the present invention with each other or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the emulsions of this invention can be blended with conventional silver halide emulsions, such as those described in Item 17643, cited above, Paragraph I.

In their simplest form photographic elements according to the present invention employ a single emulsion layer containing a high aspect ratio tabular grain silver bromoiodide emulsion according to the present invention and a photographic support. It is, of course, recognized that more than one silver halide emulsion layer as well as overcoat, subbing, and interlayers can be usefully included. Instead of blending emulsions as described above the same effect can usually be achieved by coating the emulsions to be blended as separate layers. Coating of separate emulsion layers to achieve exposure latitude is well known the art, as illustrated by Zelikman and Levi, *Making and Coating Photographic Emulsions,* Focal Press, 1964, pp. 234–238; Wyckoff U.S. Pat. No. 3,663,228; and U.K. Pat. No. 923,045. It is further well known in the art that increased photographic speed can be realized when faster and slower emulsions are coated in separate layers as opposed to blending. Typically the faster emulsion layer is coated to lie nearer the exposing radiation source than the slower emulsion layer. This approach can be extended to three or more superimposed emulsion layers. Such layer arrangements are specifically contemplated in the practice of this invention.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, anti-static, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an $\alpha$-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al U.S. Pat. No. 3,411,908 and Joseph et al U.S. Pat. No. 3,630,740, over polystyrene and polyester film supports, as illustrated by Crawford et al U.S. Pat. No. 3,630,742, or can be employed as unitary flexible reflection supports, as illustrated by Venor et al U.S. Pat. No. 3,973,963.

Preferred cellulose ester supports are cellulose triacetate supports, as illustrated by Fordyce et al U.S. Pat. Nos. 2,492,977, '978 and 2,739,069, as well as mixed cellulose ester supports, such as cellulose acetate propionate and cellulose acetate butyrate, as illustrated by Fordyce et al U.S. Pat. No. 2,739,070.

Preferred polyester film supports are comprised of linear polyester, such as illustrated by Alles et al U.S. Pat. No. 2,627,088, Wellman U.S. Pat. No. 2,720,503, Alles U.S. Pat. No. 2,779,684 and Kibler et al U.S. Pat. No. 2,901,466. Polyester films can be formed by varied techniques, as illustrated by Alles, cited above, Czerkas et al U.S. Pat. No. 3,663,683 and Williams et al U.S. Pat. No. 3,504,075, and modified for use as photographic film supports, as illustrated by Van Stappen U.S. Pat. No. 3,227,576, Nadeau et al U.S. Pat. No. 3,501,301, Reedy et al U.S. Pat. No. 3,589,905, Babbitt et al U.S. Pat. No. 3,850,640, Bailey et al U.S. Pat. No. 3,888,678, Hunter U.S. Pat. No. 3,904,420 and Mallinson et al U.S. Pat. No. 3,928,697.

The photographic elements can employ supports which are resistant to dimensional change at elevated temperatures. Such supports can be comprised of linear condensation polymers which have glass transition temperatures above about 190° C., preferably 220° C., such as polycarbonates, polycarboxylic esters, polyamides, polysulfonamides, polyethers, polyimides, polysulfonates and copolymer variants, as illustrated by Hamb U.S. Pat. Nos. 3,634,089 and 3,772,405; Hamb et al U.S. Pat. Nos. 3,725,070 and 3,793,249; Wilson *Research Disclosure,* Vol. 118, February 1974, Item 11833, and Vol. 120, April 1974, Item 12046; Conklin et al *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol. 106, February 1973, Item 10613; *Research Disclosure,* Vol. 117, January 1974, Item 11709, and *Research Disclosure,* Vol. 134, June 1975, Item 13455.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application W080/01614, published Aug. 7, 1980, (Belgian Pat. No. 881,513, Aug. 1, 1980, corresponding), Blazey et al U.S. Pat. No. 4,307,165 and Gilmour et al U.S. Ser. No. 293,080, filed Aug. 17, 1981, here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black-and-white imaging applications—particularly where the photographic image is intended to be enlarged.

The photographic elements of the present invention can be imagewise exposed in any conventional manner. Attention is directed to *Research Disclosure* Item 17643, cited above, Paragraph XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. For black-and-white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography-Materials, Processes and Systems,* VanNostrand Reinhold Company, 7th Ed., 1977.

Included among the processing methods are web processing, as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, *Monobath Manual,* Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al U.S. Pat. No. 3,232,761; roller transport processing, as illustrated by Russell et al U.S. Pat. Nos. 3,025,779 and 3,515,556, Masseth U.S. Pat. No. 3,573,914, Taber et al U.S. Pat. No. 3,647,459 and Rees et al U.K. Pat. No. 1,269,268; alkaline vapor processing, as illustrated by *Product Licensing Index,* Vol. 97, May 1972, Item 9711, Goffe et al U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; reversal processing, as illustrated by Henn et al U.S. Pat. No. 3,576,633; and surface application processing, as illustrated by Kitze U.S. Pat. No. 3,418,132.

Once a silver image has been formed in the photographic element, it is conventional practice to fix the undeveloped silver halide. The high aspect ratio tubular grain emulsions of the present invention are particularly advantageous in allowing fixing to be accomplished in a shorter time period. This allows processing to be accelerated.

The photographic elements and the techniques described above for producing silver images can be readily adapted to provide a colored image through the use of dyes. In perhaps the simplest approach to obtaining a projectable color image a conventional dye can be incorporated in the support of the photographic element, and silver image formation undertaken as described above. In areas where a silver image is formed the element is rendered substantially incapable of transmitting light therethrough, and in the remaining areas light is transmitted correspondingly in color to the color of the support. In this way a colored image can be readily formed. The same effect can also be achieved by using a separate dye filter layer or element with a transparent support element.

The silver halide photographic elements can be used to form dye images therein through the selective destruction or formation of dyes. The photographic elements described above for forming silver images can be used to form dye images by employing developers containing dye image formers, such as color couplers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al, *Die Chemie,* Vol. 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930. The dye-forming couplers can be incorporated in different amounts to achieve differing photographic effects. For example, U.K. Pat. No. 923,045 and Kumai et al U.S. Pat. No.

3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. Dye-forming couplers and nondye-forming compounds which upon coupling relese a variety of photographically useful groups are described by Lau U.S. Pat. No. 4,248,962. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129. Silver halide emulsions which are relatively light insensitive, such as Lippman emulsions, have been utilized as interlayers and overcoat layers to prevent or control the migration of development inhibitor fragments as described in Shiba et al U.S. Pat. No. 3,892,572.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337 and Smith et al U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette, *Research Disclosure,* Vol. 148, August 1976, Items 14836, 14846 and 14847. The photographic elements can be particularly adapted to form dye images by such processes, as illustrated by Dunn et al U.S. Pat. No. 3,822,129, Bissonette U.S. Pat. Nos. 3,834,907 and 3,902,905, Bissonette et al U.S. Pat. No. 3,847,619 and Mowrey U.S. Pat. No. 3,904,413.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazin dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

It is common practice in forming dye images in silver halide photographic elements to remove the silver which is developed by bleaching. Such removal can be enhanced by incorporation of a bleach accelerator or a precursor thereof in a processing solution or in a layer of the element. In some instances the amount of silver formed by development is small in relation to the amount of dye produced, particularly in dye image amplification, as described above, and silver bleaching is omitted without substantial visual effect. In still other applications the silver image is retained and the dye image is intended to enhance or supplement the density provided by the image silver. In the case of dye enhanced silver imaging it is usually preferred to form a neutral dye or a combination of dyes which together produce a neutral image. Neutral dye-forming couplers useful for this purpose are disclosed by Pupo et al *Research Disclosure,* Vol. 162, October 1977, Item 16226. The enhancement of silver images with dyes in photographic elements intended for thermal processing is disclosed in *Research Disclosure,* Vol. 173, September 1973, Item 17326, and Houle U.S. Pat. No. 4,137,079. It is also possible to form monochromatic or neutral dye images using only dyes, silver being entirely removed from the image-bearing photographic elements by bleaching and fixing, as illustrated by Marchant et al U.S. Pat. No. 3,620,747.

The photographic elements can be processed to form dye images which correspond to or are reversals of the silver halide rendered selectively developable by imagewise exposure. Reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al U.S. Pat. No. 2,252,718, Schwan et al U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* Aug. 2, 1974, pp. 668–669; and (iii) where the photographic elements contain bleachable dyes, silver-dye-bleach processing, as illustrated by the Cibachrome P-10 and P-18 processes described in the *British Journal of Photography Annual,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al U.S. Pat. No. 3,647,452, Puschel et al German Pat. No. 1,257,570 and U.S. Pat. Nos. 3,457,077 and 3,467,520, Accary-Venet et al U.K. Pat. No. 1,132,736, Schranz et al German Pat. No. 1,259,700, Marx et al German Pat. No. 1,259,701 and Muller-Bore German OLS No. 2,005,091.

Dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images.

The present invention can be employed to produce multicolor photographic images, as taught by Kofron et al, cited above. Generally any conventional multicolor imaging element containing at least one silver halide emulsion layer can be improved merely by adding or substituting a high aspect ratio tabular grain emulsion according to the present invention. The present invention is fully applicable to both additive multicolor imaging and subtractive multicolor imaging.

To illustrate the application of this invention to additive multicolor imaging, a filter array containing interlaid blue, green, and red filter elements can be employed in combination with a photographic element according to the present invention capable of producing a silver image. A high aspect ratio tabular grain emulsion of the present invention which is panchromatically sensitized and which forms a layer of the photographic element is imagewise exposed through the additive primary filter array. After processing to produce a silver image and viewing through the filter array, a multicolor image is seen. Such images are best viewed by projection. Hence both the photographic element and the filter array both have or share in common a transparent support.

Significant advantages can be realized by the application of this invention to multicolor photographic elements which produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively.

Although only one high aspect ratio tubular grain silver chloride emulsion as described above is required, the multicolor photographic element contains at least three separate emulsions for recording blue, green, and red light, respectively. The emulsions other than the required high aspect ratio tabular grain green or red recording emulsion can be of any convenient conventional form. Various conventional emulsions are illustrated by *Research Disclosure,* Item 17643, cited above, Paragraph I, Emulsion preparation and types, here incorporated by reference. If more than one emulsion layer is provided to record in the blue, green, and/or red portion of the spectrum, it is preferred that at least the faster emulsion layer contain a high aspect ratio tabular grain emulsion as described above. It is, of course, recognized that all of the blue, green, and red recording emulsion layers of the photographic element can advantageously be tabular grain emulsions according to this invention, if desired.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al U.S. Pat. No. 2,937,086 and/or in interlayers between adjacent color-forming layer units, as illustrated by Weissberger et al U.S. Pat. No. 2,336,327.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

The multicolor photographic elements can take any convenient form consistent with the requirements indicated above. Any of the six possible layer arrangements of Table 27a, p. 211, disclosed by Gorokhovskii, *Spectral Studies of the Photographic Process,* Focal Press, New York, can be employed. To provide a simple, specific illustration, it is contemplated to add to a conventional multicolor silver halide photographic element during its preparation one or more high aspect ratio tabular grain emulsion layers sensitized to the minus blue portion of the spectrum and positioned to receive exposing radiation prior to the remaining emulsion layers. However, in most instances it is preferred to substitute one or more minus blue recording high aspect ratio tabular grain emulsion layers for conventional minus blue recording emulsion layers, optionally in combination with layer order arrangement modifications. Alternative layer arrangements can be better appreciated by reference to certain preferred illustrative forms.

Layer Order Arrangement I

Exposure
↓
B
IL
TG
IL
TR

Layer Order Arrangement II

Exposure
↓
TFB
IL
TFG
IL
TFR
IL
SB
IL
SG
IL
SR

Layer Order Arrangement III

Exposure
↓
TG
IL
TR
IL
B

Layer Order Arrangement IV

Exposure
↓
TFG
IL
TFR
IL
TSG
IL
TSR
IL
B

Layer Order Arrangement V

Exposure
↓
TFG
IL
TFR
IL
TFB
IL
TSG
IL
TSR
IL
SB

Layer Order Arrangement VI

Exposure
↓
TFR
IL
TB
IL
TFG
IL
TFR
IL
SG
IL
SR

Layer Order Arrangement VII

Exposure
↓
TFR
IL
TFG
IL
TB
IL
TFG
IL
TSG
IL
TFR
IL
TSR where

B, G and R designate blue, green, and red recording color-forming layer units, respectively;

T appearing before the color-forming layer unit B, G, or R indicates that the emulsion layer or layers contain a high aspect ratio tabular grain silver chloride emulsion, as more specifically described above, F appearing before the color-forming layer unit B, G, or R indicates that the color-forming layer unit is faster in photographic speed than at least one other color-forming layer unit which records light exposure in the same third of the spectrum in the same Layer Order Arrangement;

S appearing before the color-forming layer unit B, G, or R indicates that the color-forming layer unit is slower in photographic speed than at least one other color-forming layer unit which records light exposure in the same third of the spectrum in the same Layer Order Arrangement; and IL designates an interlayer containing a scavenger, but substantially free of yellow filter material. Each faster or slower color-forming layer unit can differ in photographic speed from another color-forming layer unit which records light exposure in the same third of the spectrum as a result of its position in the Layer Order Arrangement, its inherent speed properties, or a combination of both.

In Layer Order Arrangements I through VII, the location of the support is not shown. Following customary practice, the support will in most instances be positioned farthest from the source of exposing radiation—that is, beneath the layers as shown. If the support is colorless and specularly transmissive—i.e., transparent, it can be located between the exposure source and the indicated layers. Stated more generally, the support can be located between the exposure source and any color-forming layer unit intended to record light to which the support is transparent.

Although photographic emulsions intended to form multicolor images comprised of combinations of subtractive primary dyes normally take the form of a plurality of superimposed layers containing incorporated dye-forming materials, such as dye-forming couplers, this is by no means required. Three color-forming components, normally referred to as packets, each containing a silver halide emulsion for recording light in one third of the visible spectrum and a coupler capable of forming a complementary subtractive primary dye, can be placed together in a single layer of a photographic element to produce multicolor images. Exemplary mixed packet multicolor photographic elements are disclosed by Godowsky U.S. Pat. Nos. 2,698,794 and 2,843,489. Although discussion is directed to the more common arrangement in which a single color-forming layer unit produces a single subtractive primary dye, relevance to mixed packet multicolor photographic elements will be readily apparent.

Figure 4:
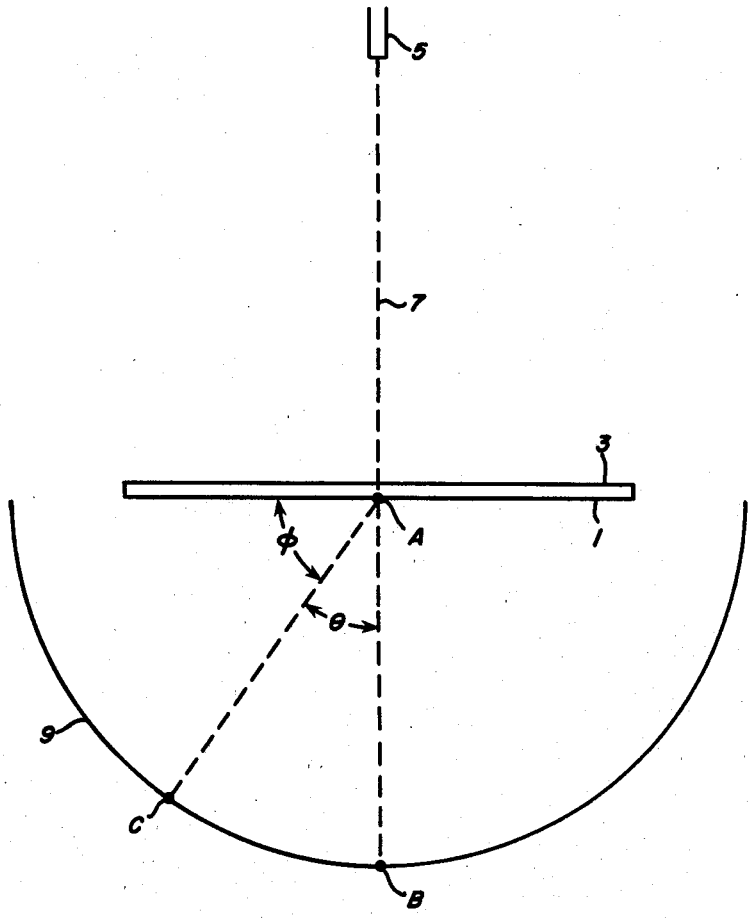
FIG. 4 is a schematic diagram illustrating sharpness characteristics.

As described by Kofron et al, cited above, the high aspect ratio tabular grain silver halide emulsions of the present invention are advantageous because of their reduced high angle light scattering as compared to nontabular and lower aspect ratio tabular grain emulsions. This can be quantitatively demonstrated. Referring to FIG. 4, a sample of an emulsion 1 according to the present invention is coated on a transparent (specularly transmissive) support 3 at a silver coverage of 1.08 g/m$^2$. Although not shown, the emulsion and support are preferably immersed in a liquid having a substantially matched refractive index to minimize Fresnel reflections at the surfaces of the support and the emulsion. The emulsion coating is exposed perpendicular to the support plane by a collimated light source 5. Light from the source following a path indicated by the dashed line 7, which forms an optical axis, strikes the emulsion coating at point A. Light which passes through the support and emulsion can be sensed at a constant distance from the emulsion at a hemispherical detection surface 9. At a point B, which lies at the intersection of the extension of the initial light path and the detection surface, light of a maximum intensity level is detected.

An arbitrarily selected point C is shown in FIG. 4 on the detection surface. The dashed line between A and C forms an angle $\phi$ with the emulsion coating. By moving point C on the detection surface it is possible to vary $\phi$ from 0° to 9°. By measuring the intensity of the light scattered as a function of the angle $\phi$ it is possible (because of the rotational symmetry of light scattering about the optical axis 7) to determine the cumulative light distribution as a function of the angle $\phi$. (For a background description of the cumulative light distribution see DePalma and Gasper, "Determining the Optical Properties of Photographic Emulsions by the Monte Carlo Method", *Photographic Science and Engineering*, Vol. 16, No. 3, May-June 1971, pp. 181-191.)

After determining the cumulative light distribution as a function of the angle $\phi$ at values from 0° to 90° for the emulsion 1 according to the present invention, the same procedure is repeated, but with a conventional emulsion of the same average grain volume coated at the same silver coverage on another portion of support 3. In comparing the cumulative light distribution as a function of the angle $\phi$ for the two emulsions, for values of $\phi$ up to 70° (and in some instances up to 80° and higher) the amount of scattered light is lower with the emulsions according to the present invention. In FIG. 4 the angle $\phi$ is shown as the complement of the angle $\phi$. The angle of scattering is herein discussed by reference to the angle $\phi$. Thus, the high aspect ratio tabular grain emulsions of this invention exhibit less high-angle scattering. Since it is high-angle scattering of light that contributes disproportionately to reduction in image sharpness, it follows that the high aspect ratio tabular grain emulsions of the present invention are in each instance capable of producing sharper images.

As herein defined the term "collection angle" is the value of the angle $\phi$ at which half of the light striking the detection surface lies within an area subtended by a cone formed by rotation of line AC about the polar axis at the angle $\phi$ while half of the light striking the detection surface strikes the detection surface within the remaining area.

While not wishing to be bound by any particular theory to account for the reduced high angle scattering properties of high aspect ratio tabular grain emulsions according to the present invention, it is believed that the large flat major crystal faces presented by the high aspect ratio tabular grains as well as the orientation of the grains in the coating account for the improvements in sharpness observed. Specifically, it has been observed that the tabular grains present in a silver halide emulsion coating are substantially aligned with the planar support surface on which they lie. Thus, light directed perpendicular to the photographic element striking the emulsion layer tends to strike the tabular grains substantially perpendicular to one major crystal face. The thinness of tabular grains as well as their orientation when coated permits the high aspect ratio tabular grain emulsion layers of this invention to be substantially thinner than conventional emulsion coatings, which can also contribute to sharpness. However, the emulsion layers of this invention exhibit enhanced sharpness even when they are coated to the same thicknesses as conventional emulsion layers.

In a specific preferred form of the invention the high aspect ratio tabular grain emulsion layers exhibit a minimum average grain diameter of at least 1.0 micron, most preferably at least 2 microns. Both improved speed and sharpness are attainable as average grain diameters are increased. While maximum useful average grain diameters will vary with the graininess that can be tolerated for a specific imaging application, the maximum average grain diameters of high aspect ratio tabular grain emulsions according to the present invention are in all instances less than 30 microns, preferably less than 15 microns, and optimally no greater than 10 microns.

Although it is possible to obtain reduced high angle scattering with single layer coatings of high aspect ratio tabular grain emulsions according to the present invention, it does not follow that reduced high angle scattering is necessarily realized in multicolor coatings. In certain multicolor coating formats enhanced sharpness can be achieved with the high aspect ratio tabular grain emulsions of this invention, but in other multicolor coating formats the high aspect ratio tabular grain emulsions of this invention can actually degrade the sharpness of underlying emulsion layers.

Referring back to Layer Order Arrangement I, it can be seen that the blue recording emulsion layer lies nearest to the exposing radiation source while the underlying green recording emulsion layer is a tabular grain emulsion according to this invention. The green recording emulsion layer in turn overlies the red recording emulsion layer. If the blue recording emulsion layer contains grains having an average diameter in the range of from 0.2 to 0.6 micron, as is typical of many nontabular emulsions, it will exhibit maximum scattering of light passing through it to reach the green and red recording emulsion layers. Unfortunately, if light has already been scattered before it reaches the high aspect ratio tabular grain emulsion forming the green recording emulsion layer, the tabular grains can scatter the light passing through to the red recording emulsion layer to an even greater degree than a conventional emulsion. Thus, this particular choice of emulsions and layer arrangement results in the sharpness of the red recording emulsion layer being significantly degraded to an extent greater than would be the case if no emulsions according to this invention were present in the layer order arrangement.

In order to realize fully the sharpness advantages in an emulsion layer that underlies a high aspect ratio tabular grain silver chloride emulsion layer according to the present invention it is preferred that the the tabular grain emulsion layer be positioned to receive light that is free of significant scattering (preferably positioned to receive substantially specularly transmitted light). Stated another way, improvements in sharpness in emulsion layers underlying tabular grain emulsion layers are best realized only when the tabular grain emulsion layer does not itself underlie a turbid layer. For example, if a high aspect ratio tabular grain green recording emulsion layer overlies a red recording emulsion layer and underlies a Lippmann emulsion layer and/or a high aspect ratio tabular grain blue recording emulsion layer according to this invention, the sharpness of the red recording emulsion layer will be improved by the presence of the overlying tabular grain emulsion layer or layers. Stated in quantitative terms, if the collection angle of the layer or layers overlying the high aspect ratio tabular grain green recording emulsion layer is less than about 10°, an improvement in the sharpness of the red recording emulsion layer can be realized. It is, of course, immaterial whether the red recording emulsion layer is itself a high aspect ratio tabular grain emulsion layer according to this invention insofar as the effect of the overlying layers on its sharpness is concerned.

In a multicolor photographic element containing superimposed color-forming units it is preferred that at least the emulsion layer lying nearest the source of exposing radiation be a high aspect ratio tabular grain emulsion in order to obtain the advantages of sharpness. In a specifically preferred form each emulsion layer which lies nearer the exposing radiation source than another image recording emulsion layer is a high aspect ratio tabular grain emulsion layer. Layer Order Arrangements II, III, IV, V, VI, and VII, above, are illustrative of multicolor photographic element layer arrangements which are capable of imparting significant increases in sharpness to underlying emulsion layers.

Although the advantageous contribution of high aspect ratio tabular grain silver chloride emulsions to image sharpness in multicolor photographic elements has been specifically described by reference to multicolor photographic elements, sharpness advantages can also be realized in multilayer black-and-white photographic elements intended to produce silver images. It is conventional practice to divide emulsions forming black-and-white images into faster and slower layers. By employing high aspect ratio tabular grain emulsions according to this invention in layers nearest the exposing radiation source the sharpness of underlying emulsion layers will be improved.

The invention is further illustrated by the following examples: In each of the examples the contents of the reaction vessel were stirred vigorously throughout silver and halide salt introductions; the term "percent" means percent by weight, unless otherwise indicated; and the term "M" stands for a molar concentration, unless otherwise indicated. All solutions, unless otherwise stated, are aqueous solutions.

EMULSIONS 1 THROUGH 3

These emulsions show the necessity of employing a thioether linkage-containing peptizer in obtaining high aspect ratio tabular grain emulsions according to the present invention.

EMULSION 1

(Control) (AgCl No Peptizer)

A 0.4 liter aqueous 1.00 molar lithium chloride solution (Solution A) containing ammonium nitrate (0.12 molar) and adenine (0.0135 molar) at 70° C. and pH 3.0 was prepared. To Solution A, maintained at the initial chloride ion concentration, were added by double-jet addition at constant flow rate for 1 minute (consuming 1.1% of the total silver) an aqueous solution of silver nitrate (7.0 molar, Solution C) and an aqueous solution (Solution B) of lithium chloride (9.0 molar), ammonium nitrate (0.25 molar) and adenine (0.027 molar).

Solutions B and C were added next by double-jet addition at an accelerated flow rate (20X from start to finish—i.e., 20 times faster at the end than at the start) for 9 minutes (98.9% of total silver consumed) while maintaining the initial chloride ion concentration. A total of 0.67 mole of silver was consumed during the precipitation. An aqueous lithium hydroxide solution (1.0 molar, Solution D) was employed to maintain pH 3.0 at 70° C.

EMULSION 2

(Control) ($AgCl_{99.8}Br_{0.2}$ Gelatin)

A 0.4 liter aqueous bone gelatin solution (1.5% gelatin, Solution A) containing calcium chloride (0.50 molar), ammonium nitrate (0.25 molar), sodium bromide (0.0025 molar) and adenine (0.0185 molar) at pH 3.0 and 70° C. was prepared. To Solution A, maintained at the initial chloride ion concentration, were added by double-jet addition at an accelerated flow rate (2X from start to finish) over a 12 minute period, aqueous solutions of silver nitrate (7.0 molar, Solution C) and calcium chloride (4.49 molar) containing ammonium nitrate (0.50 molar), Solution B. An aqueous solution of sodium hydroxide was used to maintain pH 3.0. Silver in the amount of 0.50 mole was consumed during the precipitation.

EMULSION 3

[$AgCl_{99.8}Br_{0.2}$ Gelatin-Peptizer TA/APSA (2:1 Weight Ratio)]

A 0.4 liter aqueous bone gelatin solution (1.5% gelatin, Solution A) containing poly(3-thiapentyl acrylate-co-3-acryloxypropane-1-sulfonic acid, sodium salt) [0.75% polymer, TA/APSA (1:6 molar ratio)], adenine (0.0185 molar), ammonium nitrate (0.25 molar), sodium bromide (0.0025 molar) and calcium chloride (0.50 molar) at pH 3.0 and 70° C. was prepared. Emulsion 3 was prepared by adding Solutions B, C and D (identical to Emulsion 2) in the same manner as described for Emulsion 2. Silver in the amount of 0.50 molar was consumed during the precipitation.

Figure 5:
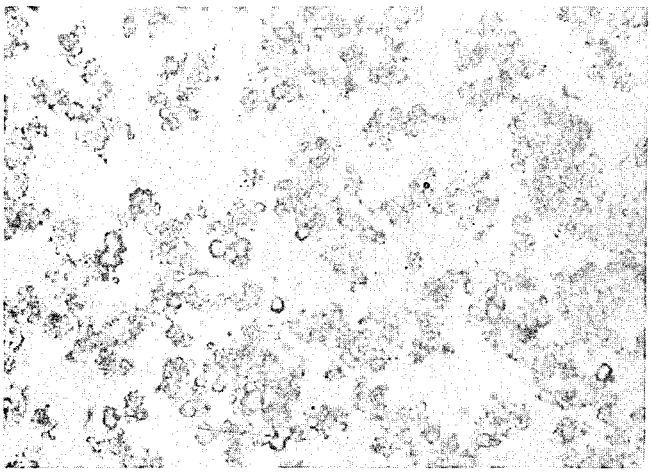
FIGS. 5 through 9, 10A, 11, and 12 through 23 are photomicrographs of emulsions according to this invention.
Figure 6:
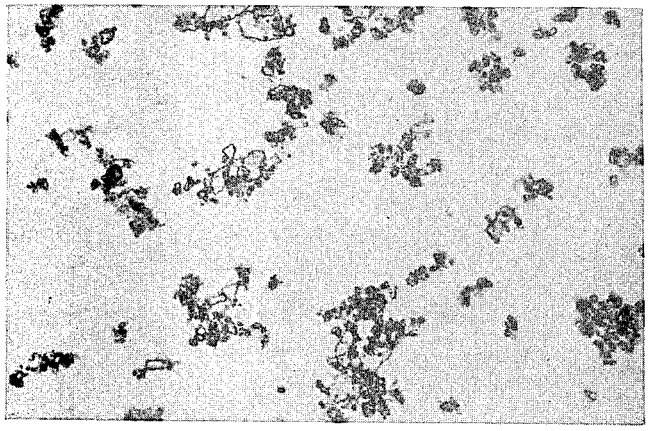
Figure 7:
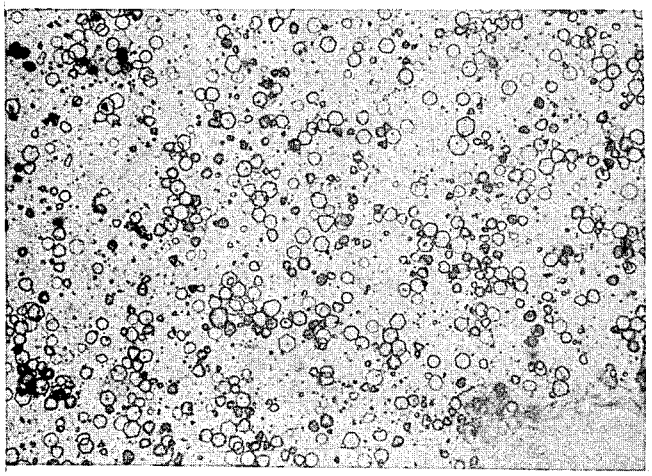

FIGS. 5, 6, and 7 are photomicrographs of Emulsion 1 (Control), Emulsion 2 (Control), and Emulsion 3. FIG. 5 is at 1500X magnification, while FIGS. 6 and 7 are at 600X magnification. Emulsion 3 contains tabular grains while Emulsions 1 and 2 show only indistinct, nontabular grain formation. Taken together Emulsions 1, 2, and 3 illustrate the importance of employing a peptizer containing a thioether linkage in order to obtain high aspect ratio tabular grain emulsions according to this invention. The grain characteristics of Emulsion 3 are more fully set out below in Table I. Although some tabular grains of less than 0.6 micron in diameter were included in computing the tabular grain average diameters and percent projected area in these and subsequent example emulsions, except where their exclusion is specifically noted, insufficient small diameter grains were present to alter significantly the numbers reported.

EMULSION 4

($AgCl_{99.7}Br_{0.3}$ Peptizer TA/APSA Single-jet)

This example illustrates the preparation of an emulsion according to the present invention by a single-jet precipitation process.

A 0.4 liter aqueous TA/APSA (1:6 molar ratio) solution (1.25% polymer, Solution A) containing calcium chloride (1.62 molar), ammonium nitrate (0.25 molar), adenine (0.015 molar) and sodium bromide (0.005 molar) at pH 3.0 and 70° C. was prepared. An aqueous solution of silver nitrate (7.0 molar, Solution B) was added by single-jet at a constant flow rate to Solution A, while maintaining the initial chloride ion concentration for 1 minute (1.1% of total silver consumed). Solution B was added next at an accelerated flow rate (20X from start to finish) until Solution B was consumed. An aqueous solution of sodium hydroxide (1.0 molar, Solution C) was used to maintain pH 3.0. Silver in the amount of 0.67 mole was used to prepare the emulsion.

The characteristics of the high aspect ratio tabular grain emulsion according to this invention prepared by this emulsion are set out below in Table I.

EMULSION 5

($AgCl_{99}Br_1$ Peptizer TA/APSA Constant Flow)

This example illustrates the use of constant flow rate in precipitating to prepare high aspect ratio tabular grain emulsions according to the present invention.

A 0.4 liter aqueous TA/APSA (1:6 molar ratio) solution (0.625% polymer, Solution A) containing calcium chloride dihydrate (0.50 molar), adenine (0.026 molar) and sodium bromide (0.013 molar) at pH 2.6 and 55° C. was prepared. To Solution A, maintained at the initial chloride ion concentration, were added by double-jet at constant flow rate for 31 minutes, aqueous solution of calcium chloride (3.0 molar, Solution B) and silver nitrate (2.0 molar, Solution C). An aqueous sodium hydroxide solution (0.2 molar, Solution D) was used to maintain pH 2.6. Silver in the amount of 0.50 mole was used to prepare the emulsion.

The grain characteristics of the emulsion prepared are summarized below in Table I.

EMULSION 6

(AgCl Peptizer TA/APSA LiCl Salts)

This example illustrates the result of substituting lithium chloride for calcium chloride.

A 0.4 liter aqueous TA/APSA (1:6 molar ratio) solution (1.32% polymer, Solution A) containing lithium chloride (1.00 molar), adenine (0.0135 molar) and ammonium nitrate (0.12 molar) at pH 3.0 and 70° C. was prepared. Solutions B, C, and D, identical to the solutions described in Emulsion 1, were prepared and added in the same manner as for Emulsion 1. Silver in the amount of 0.67 mole was used to prepare the emulsion.

The grain characteristics of the emulsion prepared are summarized below in Table I.

EMULSION 7

($AgCl_{99}Br_1$ Peptizer TA/APSA)

This example illustrates obtaining a high aspect ratio tabular grain emulsion according to the present invention employing lower reaction vessel temperatures and chloride concentration.

A 0.4 liter aqueous TA/APSA (1:6 molar ratio) solution (0.63% polymer, Solution A) containing adenine (0.026 molar), calcium chloride (0.44 molar), ammonium nitrate (0.25 molar) and sodium bromide (0.013 molar) at pH 2.6 and 55° C. was prepared. To Solution A, maintained at the initial chloride ion concentration, were added by double-jet addition at constant flow rate for 1 minute (0.8% of total silver consumed), aqueous solutions of calcium chloride (3.5 molar, Solution B) and silver nitrate (2.0 molar, Solution C).

After the initial minute, Solutions B and C were added by double-jet at the same accelerated flow rate profile (4X from start to finish) for approximately 11 minutes (22.0% of total silver consumed) except that Solution B's flow rate was half the flow rate of Solution C.

After the 11 minute accelerated rate addition period, Solutions B and C were added at constant flow rate for 19 minutes; Solution B's flow rate was half the flow rate of Solution C (77.2% of total silver consumed). An aqueous solution of sodium hydroxide (1.0 molar, Solution D) was used to maintain pH 2.6. The initial chloride ion concentration was maintained throughout the precipitation. Silver in the amount of 0.50 mole was used to prepare the emulsion.

Figure 8:
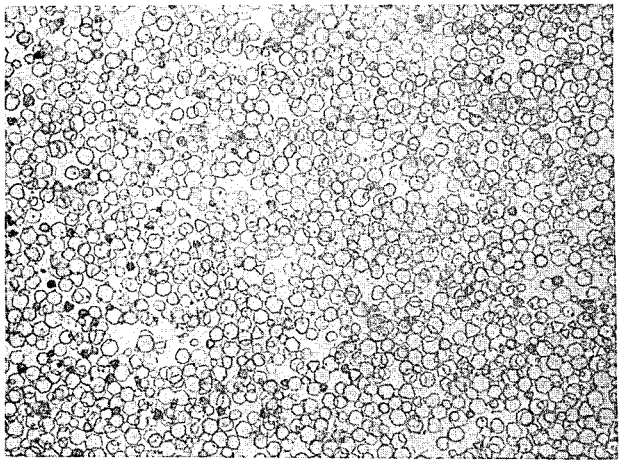

The grain characteristics of the emulsion prepared are summarized below in Table I. A photomicrograph of the emulsion prepared at 600X enlargement is shown in FIG. 8.

EMULSION 8

(AgCl Peptizer TA/APSA No $NH_4^+$ or $Br^-$ in reaction vessel)

This example illustrates obtaining a high aspect ratio tabular grain emulsion according to the present invention without incorporating either ammonium or bromide ion in the reaction vessel.

A 0.4 liter aqueous TA/APSA (1:6 molar ratio) solution (0.63% polymer, Solution A) containing adenine (0.026 molar) and calcium chloride (0.44 molar) at pH 2.6 and 55° C. was prepared. To Solution A maintained at the initial chloride ion concentration were added by double-jet addition at constant flow rate for 1 minute (1.6% of total silver consumed( aqueous solutions of calcium chloride (3.0 molar) containing sodium hydroxide (0.014 molar), Solution B and silver nitrate (4.0 molar, Solution C). After the initial minute, Solutions B and C were added by double-jet addition, while maintaining the initial chloride ion concentration, at an accelerated flow rate (4X from start to finish) for 11 minutes (44.0% of total silver consumed).

After this 11 minute accelerated flow rate period, Solutions B and C were added at constant flow rate for 6.5 minutes (54.4% of total silver consumed).

Silver in the amount of 0.50 mole was used to prepare this emulsion.

The grain characteristics of the emulsion prepared are summarized below in Table I.

EMULSION 9

(AgCl Peptizer TA/APSA 85° C.)

This example illustrates obtaining high aspect ratio tabular grain emulsion according to the present invention at precipitation temperature of 85° C.

A 0.4 liter aqueous TA/APSA (1:6 molar ratio) solution (1.25% polymer, Solution A) containing calcium chloride (0.50 molar), adenine (0.026 molar) and ammonium nitrate (0.25 molar) at pH 3.0 and 85° C. was prepared. Aqueous solutions of calcium chloride (4.5 molar) containing ammonium nitrate (0.50 molar), Solution B, silver nitrate (7.0 molar, Solution C) and lithium hydroxide (1.0 molar, Solution D) were prepared and added to Solution A, while maintaining the initial chloride ion concentration, in the same manner as described for Emulsion 1. Silver in the amount of 0.67 mole was used to prepare this emulsion.

Figure 9:
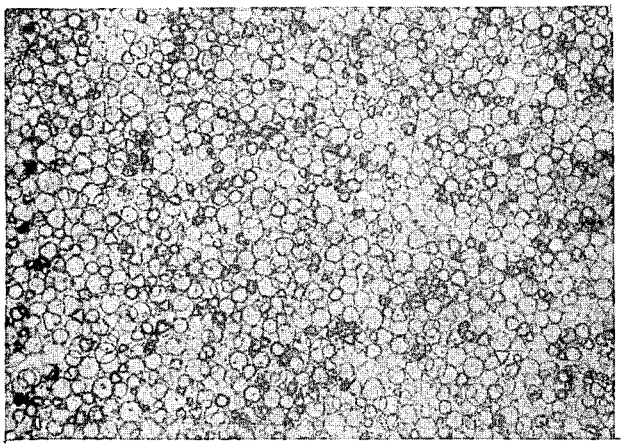

The grain characteristics of the emulsion prepared are summarized below in Table I. A photomicrograph of the emulsion prepared at 600X is shown in FIG. 9.

EMULSION 10

($AgCl_{99}Br_1$ Peptizer TA/APSA)

This example illustrates the unique tabular crystal structure which can be produced by the practice of this invention.

A 2.0 liter aqueous TA/APSA (1:6 molar ratio) solution (0.63% polymer, Solution A) containing adenine (0.026 molar), calcium chloride (0.50 molar), ammonium nitrate (0.25 molar) and sodium bromide (0.013 molar) at pH 2.6 and 55° C. was prepared. To Solution A, maintained at the initial chloride ion concentration, were added by double-jet addition at constant flow rate for 1 minute (1.6% of total silver consumed), aqueous solutions of calcium chloride (3.0 molar, Solution B) and silver nitrate (4.0 molar, Solution C).

After the initial minute at constant flow rate, Solutions B and C were added, while maintaining the initial chloride ion concentration, at an accelerated flow rate (4X from start to finish) for 11 minutes (44.0% of total silver consumed).

After the 11 minute accelerated flow rate period, Solutions B and C were added at constant flow rate, while maintaining the initial chloride ion concentration for approximately 9 minutes (54.4% of total silver consumed).

An aqueous solution of sodium hydroxide (1.0 molar, Solution D) was used to maintain pH 2.6. Silver in the amount of 2.5 moles was used to prepare this emulsion.

Figure 10A:
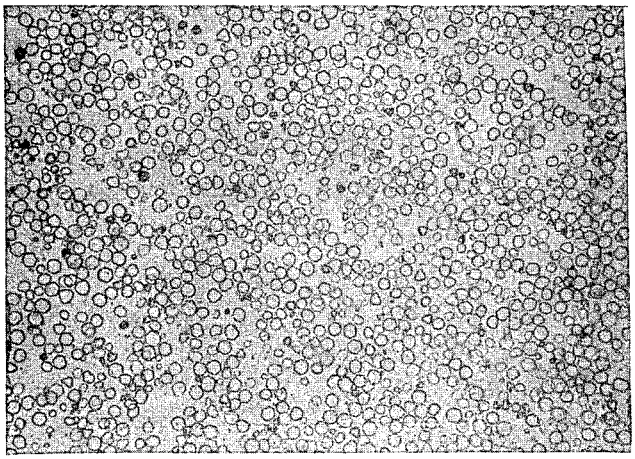
Figure 10C:
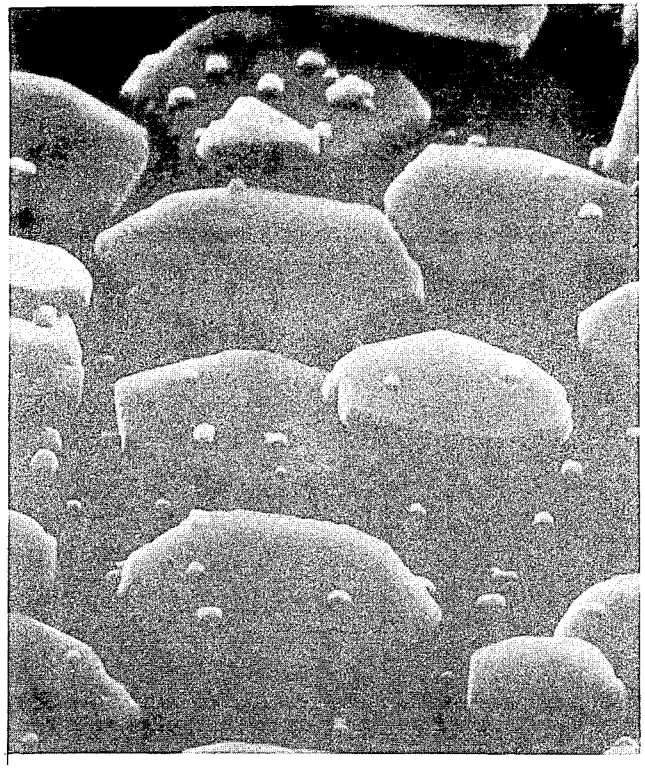
FIGS. 10B and 10C are electron micrographs of silver halide grains.
Figure 10B:
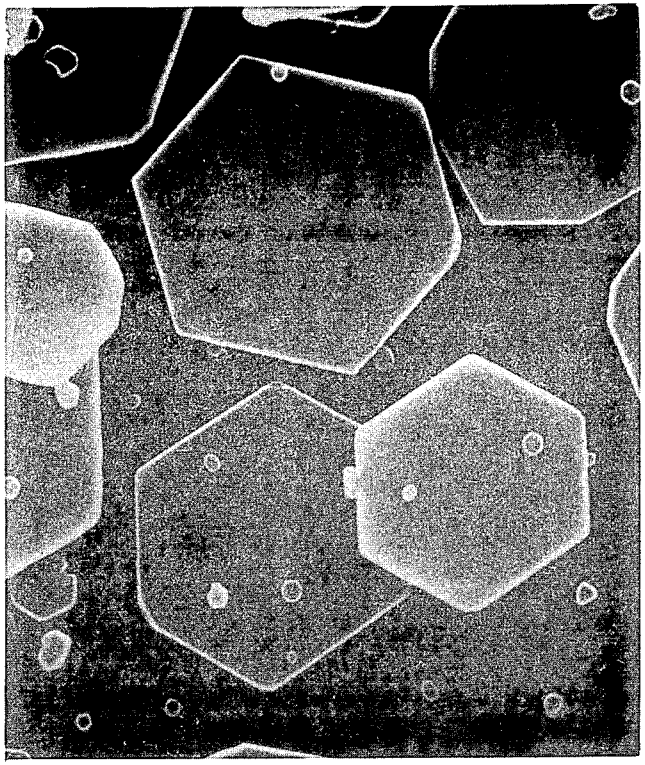

The grain characteristics of the emulsion prepared are summarized below in Table I. A photomicrograph of the emulsion prepared at 600X enlargement is shown in FIG. 10A. FIGS. 10B and 10C are electron micrographs of samples of Emulsion 10 taken from directly above (0° tilt) and from an angle (60° tilt). The enlargement in FIGS. 10B and 10C is 10,000X.

To compare the crystallographic structure of the high aspect ratio tabular grains of Emulsion 10 with a conventional emulsion containing high aspect ratio tabular grains, a grain from a high aspect ratio tabular grain silver bromide emulsion was employed as a control. It is generally acknowledged in the art that tabular silver bromide grains are bounded entirely by {111} crystal planes. The tabular silver bromide grain to be examined for purposes of comparison was cooled to the temperature of liquid nitrogen and placed in an electron microscope operated at 100 kilovolts. The electron beam in penetrating the tabular silver bromide grain was diffracted by crystal planes. Surrounding the central beam in FIG. 10D there are in evidence six spots which are equidistant from the central beam location. These spots are reflections from {220} crystal planes. (A second, outer ring of spots can also be seen, but there are reflections from different crystal planes and are not of immediate interest.) To show the relationship between the electron beam diffraction spot pattern produced and the crystal edge structure, an electron micrograph of the grain examined is shown properly angularly oriented on the electron beam diffraction pattern. (Proper angular orientation was ascertained by using an asymmetrical crystal of known diffraction characteristics for purposes of calibration.) From the composite which forms FIG. 10D it can be noted that the six innermost reflection spots corresponding to reflections from {220} planes each fall on a line between the central electron beam and an apex of the hexagon defined by the tabular silver bromide grain.

Figures 10D, 10E:
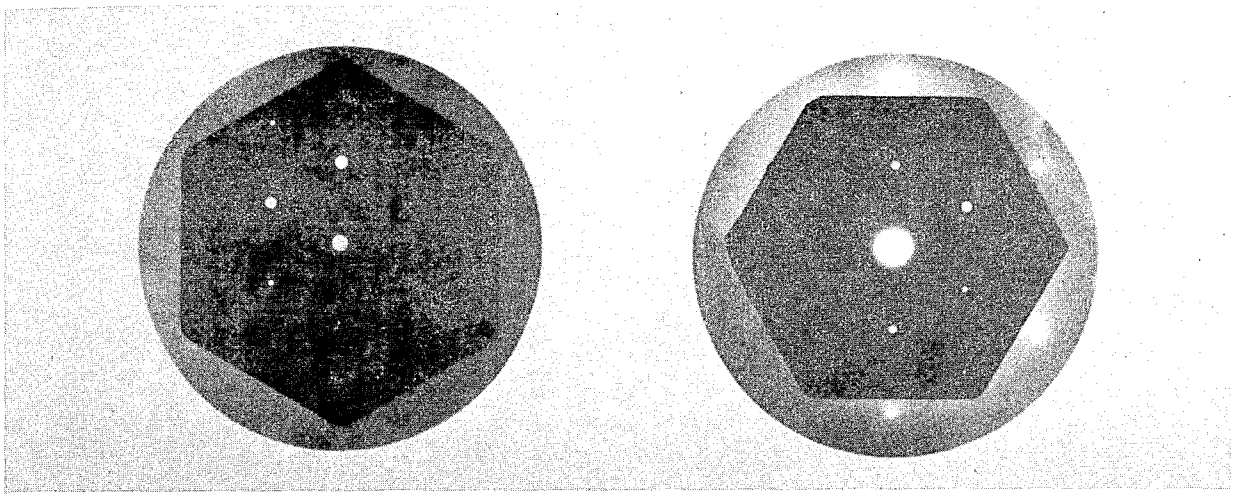
FIGS. 10D and 10E are plan views of silver halide grains showing diffraction patterns.

FIG. 10E was formed comparably as FIG. 10D, but with the substitution of a tabular grain taken from Emulsion 10. It is to be noted that the inner ring of six spots equidistant from the central electron beam location do not fall on a line between the central beam location and the apices of the hexagonal tabular grain. As referred to the grain edges, the diffraction pattern from the {220} crystal faces appear to be rotated 30° as compared to the diffraction pattern seen in FIG. 10D. This is proof of the unique crystallographic orientation of the tabular grains of the present invention. In FIG. 10E the <211> vectors, not shown, which lie in the plane of the major faces are perpendicular to intersecting lines connecting adjacent of the six diffraction spots. The <211> vectors in each instance extend from the central spot on the grain to an apex and are parallel to one of the crystal faces. Thus, six of the crystal faces of the tabular grain according to the invention shown in FIG. 10E are parallel to a <211> crystallographic vector.

From this and other emulsion samples similarly examined it is believed that the tabular grains of each of Emulsions 4 through 9 exhibit a similar crystallographic structure.

EMULSION 11

($AgCl_{99}Br_1$ Peptizer TPMA/AA/MOES)

This example illustrates the preparation of an emulsion according to this invention employing a varied thioether linkage containing peptizer. This example further illustrates response to spectral sensitization.

A 2.0 liter aqueous solution (Solution A, 0.63% polymer) containing poly(3-thiapentyl methacrylate-co-acrylic acid-co-2-methacryloyloxyethyl-1-sulfonic acid, sodium salt) (TPMA/AA/MOES, 1:2:7 molar ratio), calcium chloride (0.50 molar), adenine (0.026 molar), and sodium bromide (0.013 molar) at pH 2.6 and 55° C. was prepared. To Solution A, maintained at the initial chloride ion concentration, were added by double-jet addition at constant flow rate for 1 minute (1.2% of total silver consumed), aqueous solutions of calcium chloride (2.0 molar, Solution B) and silver nitrate (2.0 molar, Solution C).

After the initial 1 minute constant flow rate period, Solutions B and C were added by double-jet at an accelerated flow rate (2.3X from start to finish) for 53 minutes (98.8% of total silver consumed) while maintaining the initial chloride ion concentration.

An aqueous solution of sodium hydroxide (0.2 molar, Solution D) was used to maintain pH 2.6. Silver in the amount of 2.5 moles was used to prepare this emulsion. The resulting emulsion was separated from most of the soluble salts by means of a hydrocyclone washing procedure after which gelatin was added.

Figure 11:
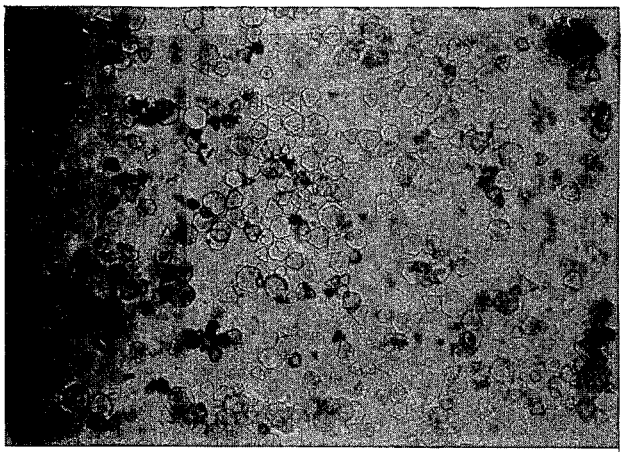

The grain characteristics of the emulsion prepared are summarized below in Table I. A photomicrograph of the emulsion prepared at 600X enlargement is shown in FIG. 11.

An unsensitized sample of Emulsion 11 was coated at 1.07 $g/m^2$ silver and 3.58 $g/m^2$ gelatin on cellulose triacetate support. The coating element contained 1.07 $g/m^2$ magenta coupler 1-(6-chloro-2,4-dimethylphenyl)-3-[α-(m-pentadecylphenoxy)butyramido]-5-pyrazolone. The coating was exposed for 4 seconds on a Horton ® spectrograph and was processed for 2 minutes in a p-phenylenediamine color developer at 33.4° C.

A second sample was coated similar to the first with the exception that prior to coating the emulsion was spectrally sensitized to the blue region with 0.25 millimole/Ag mole 5-(3-ethyl-2-benzothiazolinylidene)-3-β-sulfoethylrhodanine plus 0.5 percent KBr/Ag mole.

A third sample was coated similar to the first with the exception that prior to coating the emulsion was spectrally sensitized to the green region with 0.25 millimole/Ag mole anhydro-5-chloro-9-ethyl-5'-phenyl-3,3'-diethyloxacarbocyanine hydroxide, p-toluene sulfonate plus 0.5 percent KBr/Ag mole.

In FIG. 11A the log sensitivity of the three samples is plotted as a function of wavelength of exposing radiation. Curves 11A, 11B, and 11C correspond to the first, second, and third samples. The curves demonstrate the effectiveness of spectral sensitization in extending the wavelength of sensitivity.

EMULSION 12

($AgCl_{94}Br_6$ Peptizer TA/APSA)

This example illustrates the preparation of an emulsion according to this invention employing a higher proportion of bromide than the previous examples.

A 0.4 liter aqueous TA/APSA (1:6 molar ratio) solution (0.63% polymer, Solution A) containing calcium chloride (0.50 molar), adenine (0.026 molar), ammonium nitrate (0.25 molar) and sodium bromide (0.013 molar) at pH 2.6 and 55° C. was prepared. Solutions B (3.00 molar calcium chloride, 0.18 molar sodium bromide) and C (4.0 molar silver nitrate) were added in the same manner as the procedure for Emulsion 8. Solution D (1.0 molar NaOH) was added to maintain pH 2.6 at 55° C. Silver in the amount of 0.50 mole was used to prepare this emulsion.

The grain characteristics of the emulsion prepared are summarized below in Table I.

EMULSION 13

($AgCl_{89}Br_{11}$ Peptizer TPMA/AA/MOES)

This example illustrates the preparation of an emulsion according to this invention employing a still higher proportion of bromide than the previous examples.

A 0.4 liter aqueous TMPA/AA/MOES (1:1:7 molar ratio) solution (0.63% polymer, Solution A) containing calcium chloride dihydrate (0.50 molar), adenine (0.026 molar) and sodium bromide (0.013 molar) at pH 2.6 and 55° C. was prepared. To Solution A, maintained at the initial chloride ion concentration throughout the entire precipitation, were added by double-jet addition at constant flow rate for 1 minute (1.6% of total silver consumed), aqueous solutions of calcium chloride (2.0 molar) containing potassium bromide (0.20 molar), Solution B and silver nitrate (2.0 molar, Solution C).

After the initial minute at constant flow rate, Solutions B and C were added by double-jet addition at an accelerated flow rate (1.75X from start to finish) for 49 minutes (98.4% of total silver consumed).

An aqueous solution of sodium hydroxide (0.20 molar, Solution D) was used to maintain pH 2.6 Silver in the amount of 0.50 mole was used to prepare this emulsion.

Figure 12:
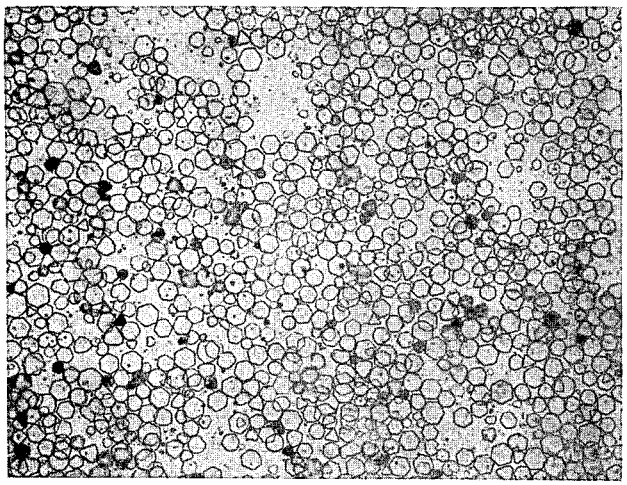

The grain characteristics of the emulsion prepared are summarized below in Table I. A photomicrograph of the emulsion prepared at 600X enlargement is shown in FIG. 12.

Individual tabular grains were analyzed for bromide using a scanning transmission electron microscope for an energy dispersive X-ray analysis along with proper reference materials. Analysis confirmed that the tabular grain contained 11 mole percent bromide.

EMULSIONS 14 THROUGH 17

These emulsions illustrate variations in the ratio of thioether linkage containing monomeric units to sulfonic acid containing monomeric units making up the polymeric peptizer.

EMULSION 14

[$AgCl_{99}Br_1$ Peptizer TPMA/MOES (1:9)]

A 0.4 liter aqueous poly(3-thiapentyl methacrylate-co-2-methacryloyloxyethyl-1-sulfonic acid, sodium salt) (TPMA/MOES, 1:9 molar ratio) solution (0.63% polymer, Solution A) containing adenine (0.026 molar), calcium chloride (0.50 molar), ammonium nitrate (0.25 molar) and sodium bromide (0.013 molar) at pH 2.6 and 55° C. was prepared. To Solution A, maintained at the initial chloride ion concentration throughout the entire precipitation, were added by double-jet addition at constant flow rate for 1 minute (1.6% of total silver consumed), aqueous solutions of calcium chloride (3.0 molar, Solution B) and silver nitrate (4.0 molar, Solution C).

After the initial minute at constant flow rate, Solutions B and C were added at an accelerated flow rate (4X from start to finish) for 11 minutes (44.0% of total silver consumed).

After the 11 minute accelerated flow rate period, Solutions B and C were added at constant flow rate for 9 minutes (54.4% of total silver consumed).

An aqueous solution of sodium hydroxide (1.0 molar, Solution D) was used to maintain pH 2.6. Silver in the amount of 0.50 mole was used to prepare this emulsion.

EMULSION 15

[$AgCl_{99}Br_1$ Peptizer TMPA/MOES (1:12)]

Emulsion 15 was prepared according to the precipitation procedure described for Emulsion 14, except the monomeric ratio of TPMA/MOES was 1:12.

EMULSION 16

[$AgCl_{99}Br_1$ Peptizer TPMA/MOES (1:15)]

Emulsion 16 was prepared according to the precipitation procedure described for Emulsion 14, except the monomeric ratio of TMPA/MOES was 1:15.

EMULSION 17

[$AgCl_{99}Br_1$ Peptizer TPMA/MOES (1:18)]

Emulsion 17 was prepared according to the precipitation procedure described for Emulsion 14, except the monomeric ratio of TPMA/MOES was 1:18.

Figure 13:
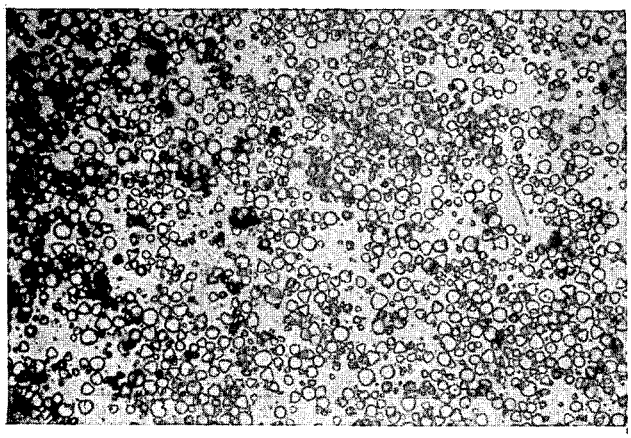

The grain characteristics of Emulsions 14–17 are summarized below in Table I. A photomicrograph of Emulsion 15 at 600X enlargement is shown in FIG. 13.

EMULSIONS 18 THROUGH 20

These emulsions illustrate further variations in the use of polymers containing thioether linkages as peptizers in the preparation of tabular grain emulsions according to this invention.

EMULSION 18

(AgCl Peptizer TAA/APSA)

A 0.4 liter aqueous poly(N-3-thiapentyl acrylamide-co-3-acryloyloxypropane-1-sulfonic acid, sodium salt) (TAA/APSA, 1:9 molar ratio) solution (1.25% polymer, Solution A) containing calcium chloride (0.50 molar), adenine (0.026 molar) and ammonium nitrate (0.25 molar) at pH 3.0 and 80° C. was prepared. Aqueous solutions B (4.5 molar calcium chloride, 0.50 molar ammonium nitrate), and C (7.0 molar silver nitrate) and sodium hydroxide (1.0 molar, Solution D) were added, while maintaining the initial chloride ion concentration, to Solution A in the same manner as described for Emulsion 1. Silver in the amount of 0.67 mole was used to prepare this emulsion.

Emulsion 18 was prepared according to the precipitation procedure for Emulsion 1 with the exception that the precipitation was conducted at 80° C.

EMULSION 19

(AgCl Peptizer TA/AA/APSA)

A 0.4 liter aqueous poly(3-thiapentyl acrylate-co-acrylic acid-co-3-acryloyloxypropane-1-sulfonic acid, sodium salt) (TA/AA/APSA, 1:2:11 molar ratio) solution (1.25% polymer, Solution A) containing calcium chloride (0.50 molar), adenine (0.026 molar) and ammonium nitrate (0.25 molar) at pH 3.0 and 80° C. was prepared. Solutions B (4.50 molar calcium chloride, 0.50 molar ammonium nitrate), C (7.0 molar silver nitrate) and D (1.0 molar sodium hydroxide) were added, while maintaining the initial chloride ion concentration throughout the entire procedure, to Solution A in the same manner as described for Emulsion 1. Silver in the amount of 0.67 mole was used to prepare this emulsion.

Emulsion 19 was prepared according to the precipitation procedure for Emulsion 1 with the exception that the precipitation was conducted at 80° C.

EMULSION 20

(AgCl Peptizer TBAA/AA/APSA)

Emulsion 20 was prepared according to the procedure for Emulsion 19 except that poly(N-3-thiabutyl acrylamide-co-acrylic acid-co-3-acryloyloxypropane-1-sulfonic acid, sodium salt) (molar ratio 1:2:7) was employed in place of TA/AA/APSA.

Figure 14:
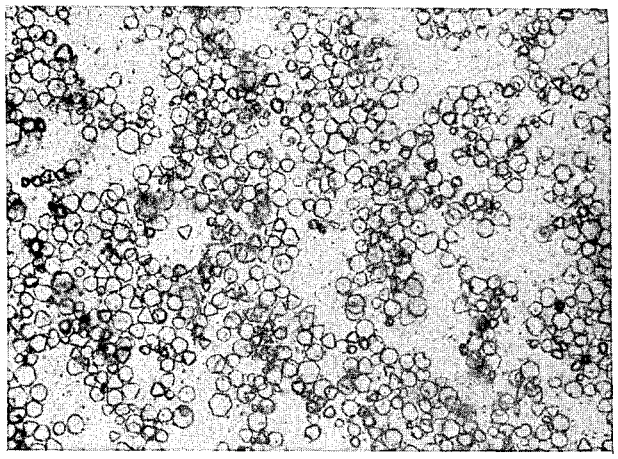
Figure 15:
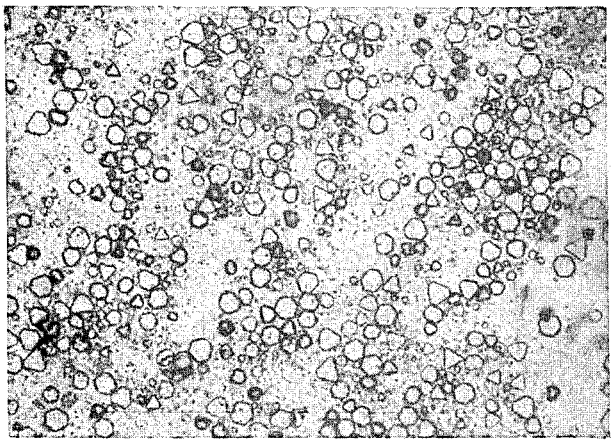

The grain characteristics of Emulsions 18 through 20 are summarized below in Table I. Photomicrographs of Emulsions 18 and 20 at 600X enlargement are shown in FIGS. 14 and 15, respectively.

EMULSION 21

($AgCl_{99}Br_1$ Peptizer TPMA/AA/MOES)

This example illustrates a relatively large tabular grain emulsion according to the present invention having a high percentage of tabular grains.

A 2.0 liter aqueous TPMA/AA/MOES (1:2:9 molar ratio) solution (0.63% polymer, Solution A) containing calcium chloride (0.50 molar) and adenine (0.026 molar) at pH 2.6 and 55° C. was prepared. To Solution A, maintained at the initial chloride ion concentration throughout the entire procedure, were added by double-jet addition at constant flow rate for 1 minute (1.2% of total silver consumed), aqueous solutions of calcium chloride (2.0 molar, Solution B) and silver nitrate (2.0 molar, Solution C).

After the initial minute of constant flow rate, Solutions B and C were added by double-jet at an accelerated flow rate (2.3X from start to finish) for 50 minutes (98.8% of total silver consumed).

An aqueous solution of sodium hydroxide (0.20 molar, Solution D) was used to maintain pH 2.6. Silver in the amount of 2.5 moles was used to prepare this emulsion.

Figure 16:
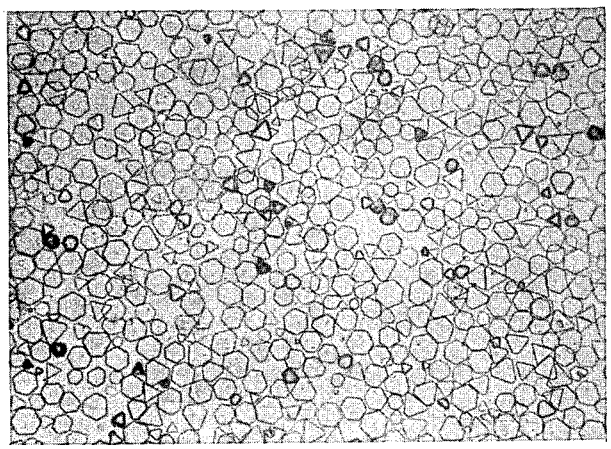

The grain characteristics of Emulsion 21 are summarized in Table I. A photomicrograph of the emulsion at 600X enlargement appears in FIG. 16.

EMULSION 22

(Blue Spectral Sensitization)

This example illustrates the photographic response of an emulsion according to the present invention when sensitized with a blue spectral sensitizing dye.

A 0.4 liter aqueous TA/APSA (1:6 molar ratio) solution (0.63% polymer, Solution A) containing calcium chloride (0.50 molar), adenine (0.026 molar) and sodium bromide (0.013 molar) at pH 2.6 and 55° C. was prepared. To Solution A, maintained at the initial chloride ion concentration, were added by double-jet addition at constant flow rate for 1 minute (1.6% of total silver consumed), aqueous solutions of calcium chloride (3.0 molar, Solution B) and silver nitrate (4.0 molar, Solution C).

After the initial 1 minute of constant flow rate, Solutions B and C were added next by double-jet addition at an accelerated flow rae (4X from start to finish) for 11 minutes (44.0% of total silver consumed).

After the 11 minute accelerated flow rate period, Solutions B and C were added at constant flow rate for approximately 10 minutes (54.4% of total silver consumed).

An aqueous solution of sodium hydroxide (0.2 molar, Solution D) was used to maintain pH 2.6 at 55° C. Silver in the amount of 0.50 mole was used to prepare this emulsion.

The emulsion was cooled to 23° C., added to 5 liters distilled water, allowed to settle, decanted, and resuspended in approximately 300 grams of aqueous bone gelatin (3% gelatin).

The emulsion was spectrally sensitized by the addition of 0.25 millimole 5-(3-ethyl-2-benzothiazolinylidene)-3-β-sulfoethylrhodanine/Ag mole and 0.5 percent KBr/Ag mole. The spectrally sensitized emulsion was coated at 1.07 g/m$^2$ silver and 3.58 g/m$^2$ gelatin on a cellulose triacetate support. The coating element also contained 1.07 g/m$^2$ magenta coupler 1-(6-chloro-2,4-dimethylphenyl)-3-[α-(m-pentadecylphenoxy)butyramido]-5-pyrazolone and was hardened with 1.1 percent bis(vinylsulfonylmethyl)ether by weight based on total gelatin content. The coating was then exposed for 2 seconds through a 0–4.0 density tablet to a 600 W 2850° K. tungsten light source. Processing was for 2 minutes in a p-phenylenediamine color developer at 33.4° C. The sensitometric results are given below.

| Spectral Sensitization | Contrast | Fog | Maximum Density |
|---|---|---|---|
| Dye + KBr | 1.44 | 0.20 | 2.05 |

Figure 17:
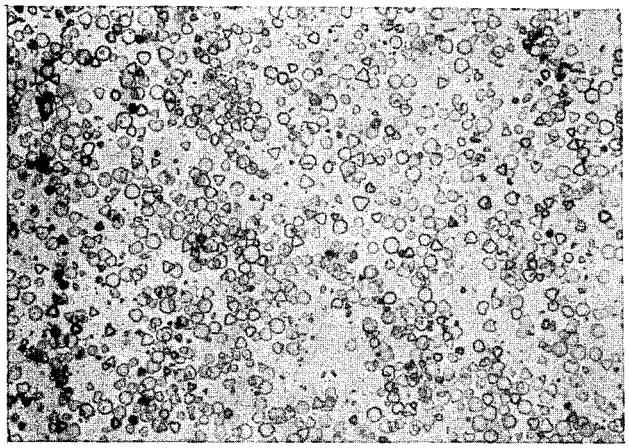

The grain characteristics of Emulsion 21 are summarized in Table I. A photomicrograph of the emulsion at 600X enlargement appears in FIG. 17.

EMULSION 23

(Coefficient of Variation)

This example illustrates the preparation of an emulsion according to the present invention which is relatively monodispersed, having a coefficient of variation of about 20.

A 0.4 liter aqueous TA/APSA (1:6 molar ratio) solution (0.63% polymer, Solution A) containing calcium chloride (0.66 molar), adenine (0.026 molar) and sodium bromide (0.013 molar) at pH 2.6 and 55° C. was prepared. To Solution A, while maintaining the original chloride ion concentration constant throughout the entire procedure, were added by double-jet addition at constant flow rate for 1 minute (0.8% of total silver consumed), aqueous solutions of calcium chloride (4.5 molar, Solution B) and silver nitrate (2.0 molar, Solution C).

After the initial minute at constant flow rate, Solutions B and C were added by double-jet addition at an acceleraed flow rate (4X from start to finish) for 11 minutes (22.0% of total silver consumed); Solution B was added at half the flow rate of Solution C.

After the 11 minute accelerated flow rate period, Solutions B and C were added at constant flow rate for approximately 23 minutes (70.0% of total silver consumed; Solution B was added at half the flow rate of Solution C.

An aqueous solution of sodium hydroxide (1.0 molar, Solution D) was used to maintain pH 2.6 at 55° C. Silver in the amount of 0.50 mole was used to precipitate this emulsion.

Figure 18:
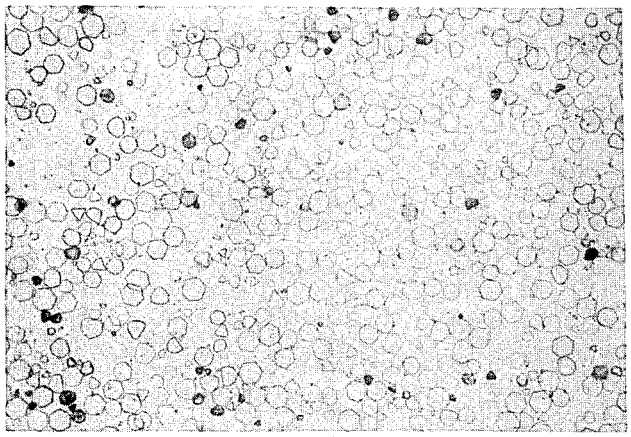

The grain characteristics of the emulsion prepared are summarized below in Table I. A photomicrograph of the emulsion at 600X enlargement appears in FIG. 18.

EMULSION 24

This example illustrates the photographic response of an emulsion according to the present invention when sensitized with a blue spectral sensitizing dye and compares its performance with that obtained when no blue spectral sensitizing dye is present.

A 4.0 liter aqueous TPMA/AA/MOES (1:2:7 molar ratio) solution (0.63% polymer, Solution A) containing calcium chloride (0.50 molar), adenine (0.026 molar) and sodium bromide (0.013 molar) at pH 2.6 and 55° C. were prepared. To Solution A, while maintaining the original chloride ion concentration throughout the entire procedure, was added by double-jet addition at constant flow rate for 1 minute (1.2% of total silver consumed), aqueous solutions of calcium chloride (2.0 molar, Solution B) and silver nitrate (2.0 molar, Solution C).

After the initial 1 minute constant flow rate period, Solutions B and C were added by double-jet addition at an accelerated flow rate (2.3X from start to finish) for 52 minutes (98.8% of total silver consumed).

An aqueous solution of sodium hydroxide (0.2 molar, Solution D) was used to maintain pH 2.6 at 55° C.; the pH gradually approaches 2.8 by the end of the procedure. Silver in the amount of 5.0 mole was used to prepare this emulsion.

The emulsion was cooled to 23° C., added to 30 liters of distilled water, allowed to settle, decanted, and resuspended in approximately 1.4 kg of 4.0% gelatin solution.

The emulsion was spectrally sensitized by the addition of 0.25 millimole 5-(3-ethyl-2-benzothiazolinylidene)-3-β-sulfoethylrhodanine/Ag mole and 0.5 percent KBr/Ag mole. The spectrally sensitized emulsion was coated at 1.07 g/m$^2$ silver and 3.58 g/m$^2$ gelatin on a cellulose triacetate support. The coating element also contained 1.07 g/m$^2$ magenta coupler 1-(6-chloro-2,4-dimethylphenyl)-3-[α-(m-pentadecylphenoxy)butyramido]-5-pyrazolone and was hardened with 1.1 percent bis(vinylsulfonylmethyl) ether by weight based on total gelatin content. The coating was then exposed for 2 seconds through a 0–4.0 density tablet to a 600 W 2850° K. tungsten light source. Processing was for 2 minutes in a p-phenylenediamine color developer at 33.4° C. The sensitometric results are given below.

| Spectral Sensitization | Relative Speed | Contrast | Fog | Maximum Density |
|---|---|---|---|---|
| None | 39 | 0.61 | 0.14 | 1.40 |
| Dye + KBr | 115 | 0.83 | 0.13 | 1.76 |

As can be seen the blue spectrally sensitized tabular grain AgClBr (99:1) emulsion resulted in 0.76 log E increased photographic sensitivity.

Figure 19:
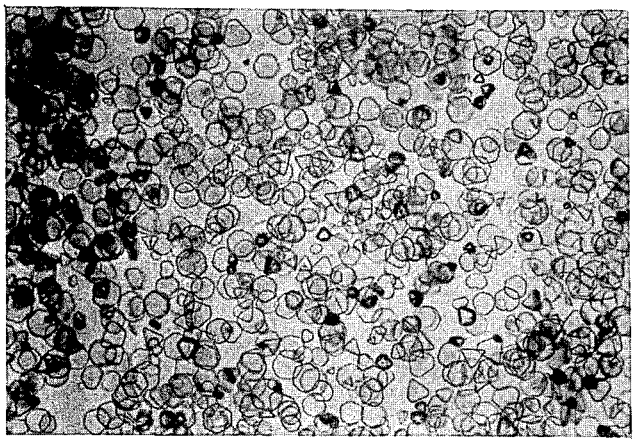

The grain characteristics of the emulsion are summarized below in Table I. A photomicrograph of the emulsion at 600X enlargement appears in FIG. 19.

TABLE I

| Emulsion No. | Cl/Br (Molar Ratio) | Peptizer (Molar Ratio) | Grain Diameter (μm) | Grain Thickness (μm) | Average Aspect Ratio | % of Projected Area |
|---|---|---|---|---|---|---|
| 1 | Cl (100) | None | | No tabular grains | | |
| 2 | 99.8:0.2 | Gelatin | | No tabular grains | | |
| 3 | 99.8:0.2 | Gelatin/ TA/APSA[1] (1:6) | 3.9 | ≈0.30 | 13:1 | >60 |
| 4 | 99.7:0.3 | TA/APSA (1:6) | 7.1 | ≈0.30 | 24:1 | >60 |
| 5 | 99:1 | TA/APSA (1:6) | 3.2 | ≈0.13 | 24:1 | >75 |
| 6 | Cl (100) | TA/APSA (1:6) | 3.5 | ≈0.20 | 18:1 | >60 |
| 7 | 99:1 | TA/APSA (1:6) | 3.8 | ≈0.20 | 19:1 | >80 |
| 8 | Cl (100) | TA/APSA (1:6) | 2.6 | ≈0.20 | 13:1 | >65 |
| 9 | Cl (100) | TA/APSA (1:6) | 5.0 | ≈0.20 | 25:1 | >70 |
| 10 | (99:1) | TA/APSA (1:6) | 3.7 | ≈0.16 | 23:1 | >75 |
| 11 | 99:1 | TPMA/AA/ MOSES[2] (1:2:7) | 5.4 | ≈0.17 | 32:1 | >70 |
| 12 | 94:6 | TA/APSA (1:6) | 3.0 | ≈0.20 | 15:1 | >60 |
| 13 | 89:11 | TPMA/AA/ MOES (1:1:7) | 5.3 | ≈0.20 | 27:1 | >75 |
| 14 | 99:1 | TPMA/ MOES[3] (1:9) | 2.4 | ≈0.20 | 12:1 | >60 |
| 15 | 99:1 | TPMA/ MOES (1:12) | 3.4 | ≈0.30 | 11:1 | >60 |
| 16 | 99:1 | TPMA/ MOES (1:15) | 4.1 | ≈0.25 | 16:1 | >65 |
| 17 | 99:1 | TPMA/ MOES (1:18) | 3.7 | ≈0.25 | 15:1 | >60 |
| 18 | Cl (100) | TAA/APSA[4] (1:9) | 4.5 | ≈0.35 | 13:1 | >70 |
| 19 | Cl (100) | TA/AA/ APSA[5] (1:2:11) | 4.3 | ≈0.20 | 22:1 | >60 |
| 20 | Cl (100) | TBAA/AA/ APSA[6] (1:2:7) | 5.5 | ≈0.40 | 14:1 | >60 |
| 21 | Cl (100) | TPMA/AA/ MOES (1:2:9) | 5.8 | ≈0.28 | 21:1 | >80 |
| 22 | 99:1 | TA/APSA (1:6) | 3–4 | ≈0.30 | 12:1 | >70 |
| 23 | 99:1 | TA/APSA (1:6) | 5.8 | ≈0.25 | 20:1 | >90 |
| 24 | 99:1 | TPMA/AA/ MOES (1:2:7) | 7.3 | ≈0.24 | 28:1 | >75 |

[1]Poly(3-thiapentyl acrylate-co-3-acryloxypropane-1-sulfonic acid, sodium salt)
[2]Poly(3-thiapentyl methacrylate-co-acrylic acid-co-2-methacryloyloxyethyl-1-sulfonic acid, sodium salt)
[3]Poly(3-thiapentyl methacrylate-co-2-methacryloyloxyethyl-1-sulfonic acid, sodium salt)
[4]Poly[N—(3-thiapentyl) acrylamide-co-3-acryloyloxypropane-1-sulfonic acid, sodium salt]
[5]Poly(3-thiapentyl acrylate-co-acrylic acid-co-3-acryloyloxypropane-1-sulfonic acid, sodium salt)
[6]Poly[N—(3-thiabutyl) acrylamide-co-acrylic acid-co-3-acryloyloxypropane-1-sulfonic acid, sodium salt)
Based on the grains having a thickness of less than 0.5 micron and a diameter of at least 0.6 micron.

The following emulsions illustrate the transition from {111} edges to {110} edges during growth of tabular grains according to the present invention. The emulsions further illustrate arresting the formation of {110} edges by the use of higher levels of adenine.

EMULSION 25A

[Tabular AgCl Grains with {110} Edges]

A 2.0 liter aqueous TPMA/AA/MOES (1:2:7 molar ratio) solution (0.63% polymer, Solution A) containing calcium chloride (0.50 molar), adenine (0.026 molar) and sodium bromide (0.013 molar) at pH 2.6 and 55° C. was prepared. To Solution A, maintained at the original chloride ion concentration throughout the entire procedure, were added by double-jet addition at constant flow rate for 1 minute (0.75% of total silver consumed) aqueous solutions of calcium chloride (2.0 molar, Solution B) and silver nitrate (2.0 molar, Solution C).

After the initial minute at constant flow rate, Solutions B and C were added by double-jet addition at an accelerated flow rate (2.3X from start to finish) for 15 minutes (18.8% of total silver consumed).

After the 15 minute acceleraed flow rate period, Solutions B and C were added by double-jet at a constant flow rate for approximately 46 minutes (80.5% of total silver consumed).

An aqueous solution of sodium hydroxide (0.2 molar, Solution D) was used to maintain pH 2.6 at 55° C. Silver in the amount of 4.0 moles was used to precipitate this emulsion.

Figure 20:
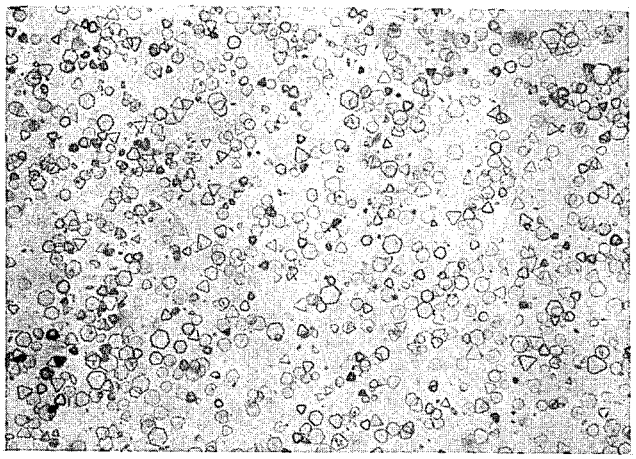
Figure 21:
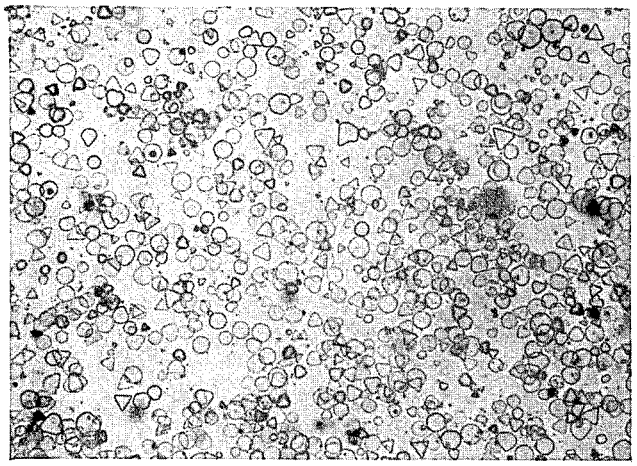
Figure 23:
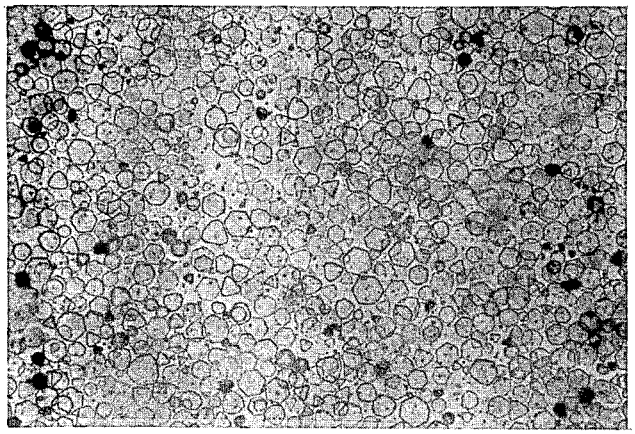
Figure 22:
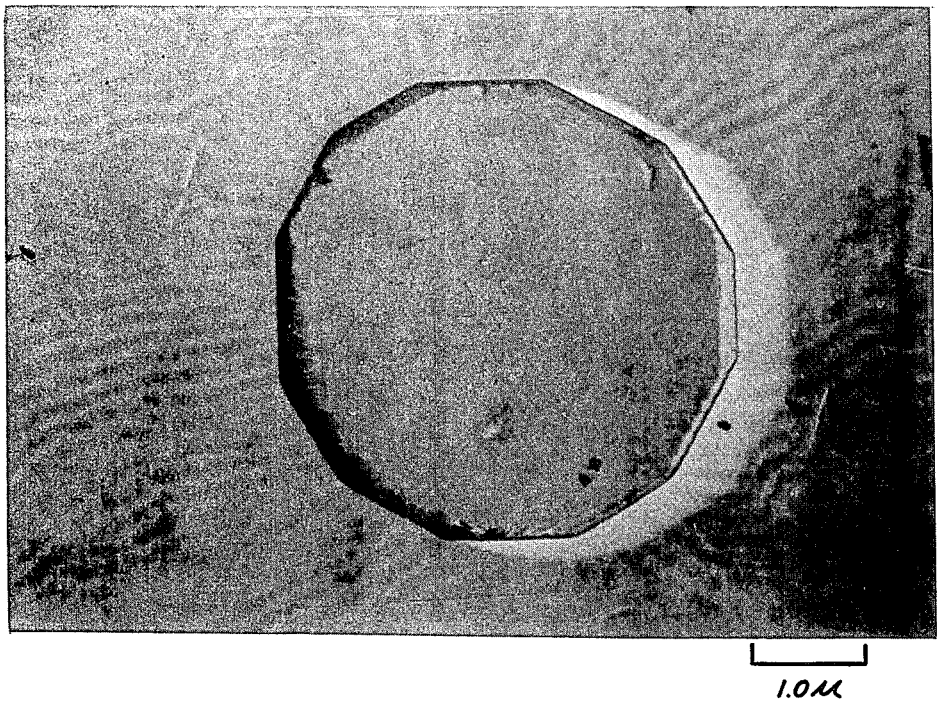

When the emulsion was examined after the introduction of 1.05 moles of Ag into the reaction vessel, the grains appeared as shown in FIG. 20. Examination of the grains determine grain edges, as discussed above in connection with Emulsion 10, revealed the tabular grain edges to lie in {111} crystallographic planes. After the introduction of 1.68 moles of Ag into the reaction vessel, the emulsion was again examined. The grains then appeared as shown in FIG. 21. FIGS. 20 and 21 are 600X enlargements. FIG. 22 is a 15,500X enlargement of a single grain taken from the emulsion as shown in FIG. 21. Note that there are 12 distinct edges present in the grain. Half of edges lie in {111} crystallographic planes and half lie in {110} crystallographic planes. After 4.0 moles of Ag had been introduced into the reaction vessel, the emulsion was again examined as described in connection with Emulsion 10. Examination revealed the tabular grains to have edges lying in {110} crystallographic planes. The emulsion at 600X enlargement is shown in FIG. 23.

This example then demonstrates that a transition can occur during tabular grain growth from {111} crystallographic plane edges to {110} crystallographic plane grain edges.

EMULSION 25B

[Tabular AgCl Grains with {111} Edges]

Emulsion 25B was precipitated in the same manner as Emulsion 25A, except that additional adenine was added during precipitation. At five minute intervals, beginning at 20 minutes into the precipitation procedure, 1.0 g of adenine, suspended in 25 ml of 0.5 molar calcium chloride solution, was added 7 times to Solution A. Nitric acid was added at the time of each adenine addition to maintain pH 2.6 at 55° C.

Emulsion 25A resulted in tabular AgCl grains which had an average thickness of 0.28 μm, an average grain size of 6.2 μm, an aspect ratio of 21:1, and 80 percent of the grains were tabular based on projected area. The presence of additional adenine during the precipitation of Emulsion 25B prevented {110} edge formation. Emulsion 25B, which had tabular grains of {111} edges, displayed an average thickness of 0.50 μm, an average grain size of 5.8 μm, an aspect ratio of 11.6:1, and 85 percent of the grains were tabular based on projected surface area.

EMULSION 26A

[Tabular AgCl Grains with {110} Edges]

A 2.0 liter aqueous solution 0.63% by weight TA/APSA (1:6 molar ratio) containing calcium chloride (0.5 molar) and adenine (0.013 molar) at pH 2.6 at 70° C. was prepared. To the solution maintained at the original chloride ion concentration throughout the entire precipitation were added by double-jet addition at a constant flow rate for 1 minute aqueous solutions of calcium chloride (b 2.0 molar) and silver nitrate (2.0 molar) consuming 19% of the total silver used.

After the initial minute at constant flow rate, the halide and silver salt solutions were added by double-jet addition at an accelerated flow rate (1.11X from start to finish) for 4 minutes, consuming 81% of the total silver used.

An aqueous solution of sodium hydroxide (0.2 molar) was used to maintain the pH at 2.6 at 70° C. Silver in the amount of 0.156 mole was used to prepare this emulsion.

The resultant AgCl emulsion contained tabular grains having hexagonal major faces and {110} edges. The tabular grains had an average diameter of 1.7 μm, an average thickness of 0.20 μm, an average aspect ratio of 8.5:1, and accounted for approximately 60% of the total grain projected area.

EMULSION 26B

[Tabular AgCl Grains with {110} and {111} Edges]

A 0.4 liter aqueous solution of 0.63% by weight poly[N-(3-thiabutyl)acrylamide-co-2-acrylamido-2-methylpropane sulfonic acid, sodium salt], (1:4 molar ratio) containing calcium chloride (0.5 molar) and adenine (0.026 mole) at pH 2.6 at 55° C. was prepared. To the solution maintained at the original chloride ion concentration throughout the entire precipitation were added by double-jet addition at a constant flow rate for 1 minute aqueous solutions of calcium chloride (2.27 molar) and silver nitrate (2.0 molar) consuming 2.5% of the total silver used.

After the initial minute at constant flow rate, the halide and silver salt solutions were added by double-jet addition at an accelerated flow rate (4.0X from start to finish) for 11 minutes consuming 67.9% of the total silver used. Then the halide and silver salt solutions were added by double-jet addition at a constant flow rate for 3 minutes consuming 29.6% of the total silver used.

An aqueous solution of sodium hydroxide (0.2 molar) was used to maintain the pH at 2.6 at 55° C. Silver in the amount of 0.16 mole was used to prepare this emulsion.

The resultant AgCl emulsion contained tabular grains having dodecagonal major faces and 6 {110} edges and 6 {111} edges located in alternating sequence. The tabular grains had an average grain diameter of 1.7 μm, an average thickness of 0.196 μm, an average aspect ratio of 8.7:1, and accounted for approximately 70% of the total grain projected area.

EMULSION 27

($AgCl_{79}Br_{21}$ Aspect Ratio 8.2:1)

The following illustrates an emulsion having an average aspect ratio slightly greater than 8:1.

A 0.4 liter aqueous solution containing 0.625 percent by weight TPMA/AA/MOES (1:1:7 molar ratio) calcium chloride (0.5 molar), sodium bromide (0.0125 molar), and adenine (0.0259 molar) was placed in a precipitation vessel and stirred at pH 2.6 at 55° C. To the precipitation vessel were added by double-jet addition for 1 minute at a constant flow rate an aqueous solution of calcium chloride (2.0 molar) containing potassium bromide (0.10 molar) and an aqueous solution of silver nitrate (2.0 molar) consuming 1.6 percent of the total silver used. Then the halide salt and silver salt solutions were added for 48.4 minutes by accelerated flow (1.75X from start to finish) consuming 98.4 percent of the total silver used. The initial chloride ion concentration was maintained in the precipitation vessel throughout the run. An aqueous sodium hydroxide solution (0.2 molar) was used to maintain the pH at 2.6. Silver in the amount of 0.5 mole was used to prepare this emulsion.

The resultant tabular grain silver chlorobromide emulsion had an average tabular grain diameter of slightly greater than 2.0 μm (2.05 μm, estimated), an average tabular grain thickness of 0.25 μm, and an average aspect ratio slightly greater than 8:1 (8.2:1, estimated). The tabular grains accounted for greater than 50 percent of the total grain projected area.

EMULSION 28

($AgCl_{93}I_7$, No Aminoazaindene)

This emulsion illustrates that iodide can be used in place of an aminoazaindene to obtain tabular grains according to the present invention. It is preferred to employ iodide in grain concentrations of from about 5 to 10 mole percent when this procedure of grain preparation is employed. Generally lower average aspect ratios are realized that when an aminoazaindene according to the preferred preparation process of this invention is employed.

A 0.4 liter of an aqueous solution 0.63% by weight TPMA/AA/MOES (1:2:7) containing potassium iodide ($1.5\times10^{-3}$ molar) and potassium chloride ($6.7\times10^{-2}$ molar) was prepared at pH 5.0 at 40° C. The temperature was increased to 60° C., and to the solution maintained at the original chloride ion concentration throughout the precipitation, were added by double-jet addition at a constant flow rate for 5 minutes an aqueous solution of potassium chloride (2.46 molar) containing potassium iodide (0.175 molar) and an aqueous silver nitrate solution (2.5 molar) consuming 1.25% of the total silver used.

After the initial 5 minutes at constant flow rate, the halide and silver salt solutions were added by double-jet addition at an accelerated flow rate (8.14X from start to finish) for 86.4 minutes consuming 98.75% of the total silver used.

The resultant silver chloroiodide (93:7 molar halide ratio) emulsion contained tabular grains with an average diameter of 3.3 μm, an average thickness of 0.33 μm, and an average aspect ratio of 10:1, which comprised approximately 55% of the total grain projected area.

EMULSION 29

(Chemically and Spectrally Sensitized $AgCl_{99}Br_1$ Emulsion)

In a reaction vessel was placed 2.0 liters of a solution containing 0.63 percent TPMA/AA/MOES (1:2:7) and 0.026 molar adenine. The solution was also 0.5 M in calcium chloride and 0.0125 M in sodium bromide. The pH was adjusted to 2.6 at 55° C. To the reaction vessel were added a 2.0 M calcium chloride solution and a 2.0 M silver nitrate solution by double-jet addition over a period of one minute at a constant flow rate consuming 1.2 percent of the total silver used. The addition of solution was then continued for 15 minutes in an accelerated flow (2.33X from start to finish) while consuming 30.0 percent of the total silver used. The pCl was maintained throughout the preparation at the value read in the reaction vessel one minute after beginning the addition. The solutions were then added for a further 26 minutes at a constant flow rate consuming 68.8 percent of the total silver used. A 0.2 M sodium hydroxide solution was added slowly during the first one-third of the precipitation to maintain the pH at 2.6 at 55° C. A total of 2.6 moles of silver were consumed during the precipitation. The emulsion was cooled to 23° C., added to 15 liters 0.001 molar $HNO_3$, allowed to settle, and finally the solids were suspended in 1 liter of 3 percent bone gelatin.

The grains of the emulsion had an average diameter of 4.5 microns and an average thickness of 0.28 micron. The grains having a thickness of less than 0.5 micron and a diameter of at least 0.6 micron exhibited an average aspect ratio of 16:1 and accounted for greater than 80 percent of the total projected area. The tabular grains appeared to be dodecahedral, suggesting the presence of {110} and {111} edges.

The tabular grain AgCl emulsion was divided into four parts. Part A was not chemically or spectrally sensitized and coated on a polyester film support at 1.07 $g/m^2$ silver and 4.3 $g/m^2$ gelatin.

Part B was sensitized in the following manner, Gold sulfide (1.0 mg/Ag mole) was added and the emulsion was held for 5' at 65° C. The emulsion was spectrally sensitized with anhydro-5-chloro-9-ethyl-5'-phenyl-3,3'-bis(3-sulfopropyl)oxacarbocyanine hydroxide, triethylamine salt (0.75 millimole/Ag mole) for 10 minutes at 40° C. and then coated like Part A. Chemical and spectral sensitization was optimum for the sensitizers employed.

Part C and D were substantially optimally sensitized according to Kofron et al. To Part C, 0.75 millimole/Ag mole of anhydro-5-chloro-9-ethyl-5'-phenyl-3,3'-bis(3-sulfopropyl)oxacarbocyanine hydroxide, triethylamine salt were added and the emulsion was held for 10 minutes at 40° C. Then 3.0 mole percent NaBr was added based on total silver halide and the emulsion was held for 5 minutes at 40° C. Then $Na_2S_2O_3.5H_2O$ (5 mg/Ag mole), NaSCN (1600 mg/Ag mole), and $KAuCl_4$ (5 mg/Ag mole) were added and the emulsion was held for 5 minutes at 65° C. prior to coating. Part D was sensitized the same as Part C except that 10 mg/Ag mole of $Na_2S_2O_3.5H_2O$ were used.

The coatings were exposed for 1/50 second to a 600 W 5500° K. tungsten light source through a 0 to 4.0 density step tablet and processed for 10 minutes at 20° C. in an ®Elon (N-methyl-p-aminophenol sulfate)-ascorbic acid surface developer. Sensitometric results are reported below.

TABLE II

| | Sensitization | Relative Speed | $D_{min}$ |
|---|---|---|---|
| Part A | None | —* | 0.05 |
| Part B | $Au_2S$ + Dye | —* | 0.05 |
| Part C | Dye + NaBr + [S + SCN + Au] | 277 | 0.06 |
| Part D | Dye + NaBr + [S + SCN + Au] | 298 | 0.13 |

*Under the conditions of this experiment maximum density failed to reach the speed threshold level of 0.1 above fog. However, under varied exposure and processing conditions imaging was obtained with Parts A and B. At 365 nm exposures Parts A and B were about 2 log E slower than Parts C and D.

Table II illustrates the superior speed of the emulsions substantially optimally sensitized according to the teachings of Kofron et al.

EMULSION 30A

(Nontabular $AgCl_{98}Br_2$ Emulsion)

This example illustrates that tabular emulsions according to the present invention exhibit higher covering power than nontabular emulsions of comparable halide compositions.

To 2.0 liters of an aqueous 0.5 molar calcium chloride bone gelatin (1.0 percent by weight gelatin) solution at pH 2.6 and 55° C. were added by double-jet at constant flow a 2.0 molar calcium chloride solution containing 0.04 molar sodium bromide and a 2.0 molar silver nitrate solution for 1 minute consuming 0.9 percent of the total silver used. Next the halide and the silver salt solutions were added for approximately 25.5 minutes by double-jet utilizing accelerated flow (3.6X from start to finish) consuming 50.5 percent of the total silver used. Then the halide and silver salt solutions were added at constant flow for an additional 15.8 minutes consuming 48.9 percent of the total silver used. The chloride ion concentration was maintained constant throughout the entire precipitation. Approximately 1.15 moles of silver were used to prepare this emulsion. Following precipitation the emulsion was dispersed in distilled water, settled, decanted, and then resuspended in approximately 0.5 liter of an aqueous bone gelatin (3.0 percent by weight) solution. The grains of the emulsion were nontabular and exhibited an average diameter of 0.94 μm.

EMULSION 30B (Tabular $AgCl_{98}Br_2$ Emulsion)

To 2.0 liters of an aqueous 0.5 molar calcium chloride and 0.026 molar adenine solution containing 0.625 percent by weight TPMA/AA/MOES (1:2:7 molar ratio) at pH 2.6 at 55° C. were added by double-jet at constant flow a 2.0 molar calcium chloride solution containing 0.04 molar sodium bromide and a 2.0 molar silver nitrate solution for 1 minute consuming 4.2 percent of the total silver used. Next the halide and silver salt solutions were added for approximately 19 minutes by double-jet utilizing accelerated flow (1.4X from start to finish) consuming 95.8 percent of the total silver used. The chloride ion concentration was maintained constant throughout the entire precipitation. Approximately 0.72 mole of silver were used to prepare this emulsion. Following precipitation the emulsion was held with stirring for 2.5 hours at 55° C. Then the emulsion was dispersed in distilled water, settled, decanted, and then resuspended in approximately 0.25 liter of an aqueous bone gelatin (3.0 percent by weight) solution.

The emulsion contained tabular grains having an average thickness of 0.3 micron, an average diameter of 2.8 microns, and an average aspect ratio of 9.3:1. The tabular grains accounted for 85 percent of the projected area of the total grain population.

Emulsion 30A was coated on polyester film support at 3.26 $g/m^2$ silver and 11.6 $g/m^2$ gelatin. Emulsion 30B was similarly coated at 3.07 $g/m^2$ silver and 11.6 $g/m^2$ gelatin. Both coatings were exposed for 1 second to a mercury vapor lamp at 365 nm wavelength through a 0–6.0 density step tablet (0.30 density steps) and processed for 6 minutes at 20° C. in an Elon ® (N-methyl-p-aminophenol sulfate)-hydroquinone developer.

Sensitometric results revealed that the tabular grain AgClBr (98:2) emulsion had higher covering power than the three-dimensional grain AgClBr (98:2) emulsion. The coating of Emulsion 30A resulted in a $D_{max}$ density of 1.07 with 96.1 percent developed silver as determined by x-ray fluorescent analysis. The coating of Emulsion 30B however resulted in a $D_{max}$ density of 1.37 with approximately 100 percent developed silver. Note that although the nontabular emulsion grains were of lower average volume per grain (0.83 $(\mu m)^3$ vs 1.85 $(\mu m)^3$ than the tabular grains and had more developed silver (3.13 $g/m^2$ vs 3.04 $g/m^2$, both of which differences worked to increase the covering power of the nontabular emulsion in comparison to the tabular emulsion, the tabular grains resulted in higher $D_{max}$ and consequently greater covering power for Emulsion 30B.

The invention has been described in detail with particular reference to preferred embodiments thereof, but it will be understood that variations and modifications can be effected within the spirit and scope of the invention.

What is claimed is:

1. In a process of preparing a radiation-sensitive photographic emulsion wherein aqueous silver and chloride-containing halide salt solutions are brought into contact in the presence of a dispersing medium to form tabular silver halide grains, the halide content of which is at least 50 mole percent chloride, based on silver, the improvement comprising reacting said aqueous silver and chloride-containing halide salt solutions in the presence of a crystal habit modifying amount of an aminoazaindene and a peptizer having a thioether linkage.

2. In a double-jet precipitation process of preparing a radiation-sensitive photographic emulsion comprised of a dispersing medium and tabular silver halide grains, the halide content of which is at least 75 mole percent chloride and up to 6 mole percent iodide, based on silver, any remaining halide being bromide, the improvement comprising concurrently introducing aqueous silver and chloride salt solutions into a reaction vessel containing at least a portion of the dispersing medium in the presence of a crystal habit modifying amount of an aminoazaindene and a peptizer having a thioether linkage to precipitate tabular grains accounting for at least 50 percent of the total projected area of the total grain population precipitated.

3. An improved process according to claim 1 in which chloride ion concentration in the reaction vessel is maintained in the range of from 0.1 to 5.0 molar during precipitation.

4. An improved process according to claim 3 in which the pH within the reaction vessel is maintained within the range of from 2 to 5.0 during precipitation.

5. An improved process according to claim 2 in which chloride ion concentration in the reaction vessel is maintained in the range of from 0.5 to 3.0 molar, the pH within the reaction vessel is maintained within the range of from 2 to 3.5, and the temperature within the reaction vessel is in the range of from 40° to 90° C.

6. An improved process according to claim 1, 2, or 4 in which the aminoazaindene is present in the reaction vessel in a concentration of at least $10^{-3}$ mole per mole of silver.

7. An improved process according to claim 6 in which an amino purine is present in a concentration of from $0.5\times10^{-2}$ to $5\times10^{-2}$ mole per mole of silver.

8. An improved process according to claim 7 in which the amino purine is adenine.

9. In an improved process according to claim 1 or 2 in which the peptizer having a thioether linkage is a water soluble linear copolymer comprised of (1) recurring units in the linear polymer chain of amides or esters of maleic, acrylic or methacrylic acids in which respective amine or alcohol condensation residues in the respective amides and esters contain an organic radical having at least one sulfide-sulfur atom linking two alkyl carbon atoms and (2) units of at least one other ethylenically unsaturated monomer.

10. In an improved process according to claim 9 in which the thioether linkage containing peptizer is present in the reaction vessel in a concentration of from 0.1 to 10 percent by weight, based on total weight, and the thioether linkage containing repeating units comprise from about 2.5 to 25 mole percent of the peptizer.

11. A radiation-sensitive photographic emulsion comprising a dispersing medium and silver halide grains which are at least 50 mole percent chloride, based on silver, at least 50 percent of the total projected area of said silver halide grains being provided by tabular grains having a thickness less than 0.5 micron, a diameter of at least 0.6 micron, and an average aspect ratio greater than 8:1, said tabular grains having two opposed substantially parallel major crystal faces lying in {111} crystal planes and exhibiting at least one of the following features:

(1) at least one peripheral edge lying parallel to a <211> crystallographic vector lying in the plane of one of said major faces and (2) at least one of bromide and iodide incorporated in a central grain region.

12. A radiation-sensitive photographic emulsion according to claim 11 in which at least 70 percent of the total projected area of said silver halide grains is provided by said tabular grains.

13. A radiation-sensitive photographic emulsion according to claim 11 in which said halide of said tabular grains is at least 75 mole percent chloride and up to 6 mole percent iodide, based on silver, any remaining halide being bromide.

14. A radiation-sensitive photographic emulsion according to claim 13 in which said tabular grains are at least 90 mole percent chloride and up to 2 mole percent iodide, based on silver.

15. A radiation-sensitive photographic emulsion according to claim 13 in which said tabular grains are polydisperse.

16. A radiation-sensitive photographic emulsion according to claim 11 in which said tabular grains are monodisperse.

17. A radiation-sensitive photographic emulsion according to claim 11 in which said tabular grains have regular hexagonal or dodecagonal major faces.

18. A radiation-sensitive photographic emulsion according to claim 11 in which said tabular grains have an average aspect ratio of at least 12:1.

19. A radiation-sensitive photographic emulsion according to claim 11 in which said tabular grains have an average thickness in the range of less than 0.3 micron.

20. A radiation-sensitive photographic emulsion according to claim 11 in which an aminoazaindene is adsorbed to the surface of said tabular grains.

21. a radiation-sensitive photographic emulsion according to claim 11 in which said dispersing medium is comprised of a peptizer containing a thioether linkage.

22. A radiation-sensitive photographic emulsion comprising a dispersing medium and silver halide grains which are at least 75 mole percent chloride and up to 6 mole percent iodide, based on silver, any remaining halide being bromide, at least 70 percent of the total projected area of said silver halide grains being provided by tabular grains having a thickness less than 0.5 micron, a diameter of at least 0.6 micron, and an average aspect ratio greater than 12:1, said tabular grains having two opposed substantially parallel major crystal faces lying in {111} crystal planes and at least one peripheral edge lying parallel to a <211> crystallographic vector lying in the plane of one of said major faces.

23. A radiation-sensitive photographic emulsion according to claim 22 wherein said tabular grains have hexagonal major crystal faces and peripheral edges lying parallel to <211> crystallographic vectors lying in the plane of one of said major faces.

24. A radiation-sensitive photographic emulsion according to claim 22 wherein said tabular grains account for at least 90 percent of the total projected area of said silver halide grains.

25. A radiation-sensitive photographic emulsion according to claim 22 wherein said tabular grains have an average thickness of less than 0.3 micron.

26. A radiation-sensitive photographic emulsion comprising a dispersing medium and silver halide grains which are at least 75 mole percent chloride and up to 6 mole percent iodide, based on total halide, any remaining halide being bromide, at least 70 percent of the total projected area of said silver halide grains being provided by tabular grains having a thickness of less than 0.5 micron, a diameter of at least 0.6 micron, and an average aspect ratio of at least 12:1, said tabular grains having two opposed substantially parallel major crystal faces lying in {111} crystal planes, and said tabular grains containing bromide in a central grain region, said bromide accounting for at least 1 mole percent of the total halide present in said tabular grains.

27. A radiation-sensitive photographic emulsion according to claim 26 including at least 90 mole percent chloride and up to 2 mole percent iodide, based on silver.

28. A radiation-sensitive photographic emulsion according to claim 26 wherein said tabular grains have an average thickness of less than 0.3 micron.

29. In a photographic element comprised of a support and at least one radiation-sensitive emulsion layer, the improvement wherein said emulsion layer is comprised of an emulsion according to claim 11, 12, 13, 14, 15, 16, 17, 18, 19, 20, 21, 22, 23, 24, 25, 26, 27, or 28.

30. A process of producing a visible photographic image comprising processing in an aqueous alkaline solution in the presence of a developing agent an imagewise exposed photographic element according to claim 29.

* * * * *